US005621450A

United States Patent [19]

Kawai et al.

[11] Patent Number: 5,621,450

[45] Date of Patent: Apr. 15, 1997

[54] CONTAINER FOR RECEIVING INK JET CARTRIDGE FOR AN INK JET RECORDING APPARATUS

[75] Inventors: Tsutomu Kawai; Akira Miyakawa; Hideki Yamaguchi, all of Yokohama; Hitoshi Nakamura, Kawasaki, all of Japan

[73] Assignee: Canon Kabushiki Kaisha, Tokyo, Japan

[21] Appl. No.: 565,012

[22] Filed: Nov. 30, 1995

Related U.S. Application Data

[63] Continuation of Ser. No. 116,703, Sep. 7, 1993, abandoned.

[30] Foreign Application Priority Data

Sep. 8, 1992 [JP] Japan ..... 4-239407
Dec. 25, 1992 [JP] Japan ..... 4-345050

[51] Int. Cl.[6] ..... B41J 2/17

[52] U.S. Cl. ..... 347/108; 347/30; 347/33

[58] Field of Search ..... 347/22, 23, 30–33, 347/29, 36, 108, 87

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,876,558 | 10/1989 | Mamiya | 347/30 |
| 5,231,416 | 7/1993 | Terasawa et al. | 346/140 R |
| 5,373,936 | 12/1994 | Kawai et al. | 347/87 |

FOREIGN PATENT DOCUMENTS

| | | | |
|---|---|---|---|
| 282327 | 9/1988 | European Pat. Off. | 347/87 |
| 451846 | 10/1991 | European Pat. Off. | 347/29 |
| 54-056847 | 5/1979 | Japan . | |
| 59-45162 | 3/1984 | Japan | 347/33 |
| 59-123670 | 7/1984 | Japan . | |
| 59-138461 | 8/1984 | Japan . | |
| 60-071260 | 4/1985 | Japan . | |
| 162960 | 7/1991 | Japan | 347/29 |

*Primary Examiner*—N. Le
*Attorney, Agent, or Firm*—Fitzpatrick, Cella, Harper & Scinto

[57] ABSTRACT

A container for storably receiving an ink jet cartridge for an ink jet recording apparatus includes a recording head section for discharging ink from a plurality of ink discharging orifices and an ink storing section. The container includes a holding member for firmly holding the ink jet cartridge at a predetermined position in the container, a capping member for sealably covering the ink discharging orifices therewith while the ink jet cartridge is firmly held in the container, a pump for sucking ink from the ink discharging orifices for activating the ink jet cartridge, and a waste ink chamber having an ink absorber received therein for retaining the sucked ink. In addition, the container includes a squeezing member adapted to be actuated from the outside for deforming the ink absorber and an ink drain port. Additionally, the container includes a connecting member for operatively connecting a case cover to a piston rod of the pump and a mechanism for releasing the connecting member from the connected state when a very large magnitude force is applied to the connecting member.

8 Claims, 20 Drawing Sheets

CONTAINER FOR RECEIVING INK JET CARTRIDGE FOR AN INK JET RECORDING APPARATUS

This application is a continuation, of application Ser. No. 08/116,703 filed Sep. 7, 1993 abandoned.

BACKGROUND OF THE INVENTION

1. Field of the Invention

The present invention relates generally to a container for storably receiving an ink jet cartridge for an ink jet recording apparatus therein. More particularly, the present invention relates to a container for storably receiving a disposable type ink jet cartridge integrated with an ink tank for the purpose of reusing the ink jet cartridge later. Further, the present invention relates to a method of exchanging an ink jet cartridge for an ink jet recording apparatus with another one when each recording operation is to be performed using a different kind of ink or when the ink stored in the ink jet cartridge is completely consumed.

2. Description of the Related Art

In recent years, many disposable type ink jet cartridges are increasingly used for ink jet recording apparatuses. When there arises a necessity that an ink jet recording apparatus performs a recording operation using a different kind of ink, the present ink jet cartridge should be exchanged with a new one having another kind of ink therein. In view of the convenience in temporarily holding the former ink jet cartridge so as to enable it to be reused later, proposals have been made with respect to a container for storably receiving a used ink jet cartridge therein. It should be noted that this type of container is prepared not only for the purpose of reusing the used ink jet cartridge later but also for the purpose of storably receiving a new ink jet cartridge therein. It is obvious that on completion of ink consumption, the container is disposed of together with the ink jet cartridge as waste.

FIG. 20 shows by way of perspective view the structure of a conventional ink jet cartridge. In this figure, reference numeral 1 designates an ink jet cartridge (IJC), reference numeral 2 designates a recording head unit integrated with the ink jet cartridge 1, and reference numeral 3 designates an ink discharging plane which is positionally coincident with the front surface of the recording head unit 2 and has a plurality of ink discharging orifices 4 formed thereon. An ink reservoir (not shown) having ink to be fed to the recording head unit 2 stored therein is received in the ink jet cartridge 1.

FIG. 21 shows by way of perspective view a typical ink jet recording apparatus IJRA for performing a recording operation with an ink jet cartridge IJC of the foregoing type mounted thereon. A carriage HC having the ink jet cartridge IJC carried thereon includes a pin (not shown) which is normally engaged with a spirally extending groove 5005 on a lead screw 5004, and as a driving motor 5013 is rotated in the normal/reverse direction and the rotation of the driving motor 5013 is transmitted to the lead screw 5004 via driving power transmission gears 5011 and 5009, the carriage HC is reciprocally displaced in the a arrow-marked/b arrow-marked direction. Reference numeral 5002 designates a retaining plate (sheet retaining plate) for retaining a recording medium P such as a sheet of paper, an OHP film or the like (hereinafter referred to a sheet). The sheet retaining plate 5002 thrusts the sheet P against a platen 5000 across the length of displacement of the carriage HC. Reference numerals 5007 and 5008 designate photocouplers, respectively. When a lever 5006 of the carriage HC enters the region where the photocouplers 5007 and 5008 are disposed, they serve as home position detecting means for detecting the presence of the lever 5006 and then shifting the present direction of rotation of the driving motor 5013 to a reverse one. Reference numeral 5016 designates a member for supporting a cap member for capping an ink discharging plane 3 positionally coincident with the front surface of a recording head unit therewith, and reference numeral 5015 designates suction means for sucking in a cap member 5022. The suction means 5015 serves to suck ink in the ink jet recording head through an opening portion 5023 of the cap member 5022 so as to recover the ink jet cartridge IJC.

Reference numeral 5017 designates a wiping blade, and reference numeral 5019 designates a member for displacing the wiping blade 5017 in the forward/rearward direction. The wiping blade 5017 and the member 5019 are supported on a support plate 5018. Reference numeral 5021 designates a lever for starting the recovery suction of the suction means 5015. The lever 5021 is driven by the driving motor 5013 via hitherto known power transmitting means such as a clutch shifting member or the like adapted to be actuated as a cam 5020 engaged with the carriage HC is rotated.

Operations of capping, wiping and recovery suction are performed at the positions corresponding to the foregoing operations when the carriage HC is located in the working region on the home position side as the lead screw 5005 is rotated.

It is desirable that a container for storably receiving the ink jet cartridge 1 for an ink jet recording apparatus IJRA therein is equipped with a cap member for the purpose of preventing ink from leaking through the ink discharging orifices 4 on the ink discharging plane 3 of the recording head unit. In this connection, a proposal has been made with respect to a container of the foregoing type wherein a pumping operation for sucking ink from the ink discharging plane 3 of the recording head unit adapted to come in contact with a cap member while an ink jet cartridge IJC is received in the container is performed in operative association with opening/closing of a case cover of the container. With the container proposed in that way, a pumping operation is performed so as to allow the recording head unit to be recovered every time the ink jet cartridge IJC is taken out of the container. This makes it possible to reduce a load to be borne by the ink jet recording apparatus IJRA for the purpose of recovery of the ink jet cartridge IJC, but there arises a necessity for disposing of a waste ink chamber in the container. To satisfy the foregoing necessity, an ink absorber is disposed in the waste ink chamber for retaining the ink uselessly discharged from the recording head unit in the ink absorber.

In addition, another proposal has been made with respect to a container of the foregoing type wherein a piston type suction pump for performing a pumping operation is actuated in operative association with opening/closing of a case cover for the container.

With each of the conventional containers proposed in the above-described manner, however, when the waste ink chamber is designed with large dimensions, the container itself is correspondingly enlarged and becomes heavy, resulting in being inconvenient to carry and being stored with some difficulty. On the other hand, when the waste ink chamber is designed with small dimensions, there arises an occasion that the container is uneconomically disposed of together with the ink jet cartridge as waste because the waste ink chamber is fully filled with the drained ink even though the ink jet cartridge itself is still reusable.

As a piston of the piston type suction pump is actuated in the upward/downward direction in operative association with opening/closing of the case cover, turnable movement of the case cover for achieving the opening/closing of the same is converted into linear movement of the piston at the joint portion between the case cover and the piston. However, since the position to be assumed by the foregoing joint portion disposed on the case cover is restrictively determined, there arises a problem in that a very large magnitude of power is applied to the joint portion, causing the latter to be undesirably damaged or broken. Another problem is that an assembling operation is achieved for the joint portion with some difficulty.

In addition, with the ink jet recording apparatus IJRA having an ink jet cartridge IJC mounted thereon for recording operations, in the case that the ink jet cartridge IJC is exchanged with another having a different color of ink stored therein for the purpose of performing a recording operation using the different ink, it is required that the latter ink jet cartridge is recovered with the aid of the wiping blade 5017, the cap member 5022 and the suction means 5015 every time the present ink jet cartridge IJC is exchanged with other one. In this case, there is a possibility that a color of ink in the ink jet cartridge IJC is mixed with the ink stored in the new ink jet cartridge with a different color. Further, since an ink absorber (not shown) received in the recovery means has a certain limit in respect of an ink absorbing capacity, there is a possibility that an extra quantity of ink leaks outside as ink is increasingly absorbed in the ink absorber every time the ink jet cartridge IJC is repeatedly exchanged with other one having a different kind of ink received therein.

A recovery unit is complicated in structure and occupies a large space in the ink jet recording apparatus IJRA. This makes it difficult to design the ink jet recording apparatus IJRA with small dimensions and light weight at a reduced cost. The more complicated the recovery unit, the more complicated the ink jet recording apparatus IJRA. Thus, trouble can readily to occur with the ink jet recording apparatus IJRA. In other words, reliability of the ink jet recording apparatus IJRA is degraded. Usually, a sheet feeding motor and a carriage driving motor arranged in the ink jet recording apparatus IJRA serve also as a power source for the recovery unit for the ink jet cartridge. This leads to the result that motors each generating a large magnitude of torque should be employed for the sheet feeding motor and the carriage driving motor.

When the ink jet cartridge is detached from the ink jet recording apparatus IJRA and a new ink cartridge is then attached to the same, there may arise a problem that a sheet of paper is contaminated with the ink scattered away from the ink jet cartridge, and moreover, the interior of the ink jet recording apparatus IJRA becomes dirty with the scattered ink.

SUMMARY OF THE INVENTION

The present invention has been made in consideration of the aforementioned background.

It is therefore an object of the present invention to provide a container for storably receiving an ink jet cartridge wherein the container includes a waste ink tank in such a manner that ink can be drained from the waste ink tank or the latter can be opened so as to allow an ink absorber in the waste ink tank to be exchanged with a new one whereby a running life of the container can be elongated.

It is another object of the present invention to provide a container for an ink jet cartridge which assures that a joint portion of the container relative to a case cover is released from the connected state only when a very large magnitude of force is applied to the joint portion, and moreover, the joint portion can easily be joined when the container is assembled.

It is a further object of the present invention to provide a container which assures that an ink jet cartridge detached from an ink jet recording apparatus can storably be received in the container without an occurrence of ink leakage, and moreover, when the ink jet cartridge storably received in the container is reused for an ink jet recording apparatus, it can be recovered in operative association with removal of the ink jet cartridge from the container.

It is yet another object of the present invention to provide a container which assures that activation of an ink jet cartridge can be shifted to deactivation of the same, and vice versa as desired.

In the first aspect of the present invention, a container for storably receiving an ink jet cartridge including a recording head section for discharging ink from a plurality of ink discharging orifices and an ink storing section having ink to be fed to the recording head section the ink storing section being integrated with the ink recording head section, the container comprises;

holding means for firmly holding the ink jet cartridge at a predetermined position therein, capping means for sealably covering the ink discharging orifices therewith while the ink jet cartridge is storably received at the predetermined position in the container, sucking means for sucking ink through the ink discharging orifices while the latter are sealably covered with the capping means, and storing means for storing the ink sucked from the ink discharging orifices by actuating the sucking means.

Here, a container may further comprise;

draining means for draining the ink stored in the storing means outside of the container.

The storing means may comprise a waste ink chamber defined in the container and an ink absorber received in the waste ink chamber.

The draining means may comprise a member adapted to be actuated from the outside for deforming the ink absorber and a drain port formed through a wall defining the waste ink chamber.

The drain port may be liquid-tightly closed with a cap member while the ink absorber is not deformed.

The member may have an elastic member at the foremost end thereof, the elastic member serving to close the drain port therewith while the ink absorber is not deformed by the member, and serving to open the drain port while the ink absorber is deformed by the member.

A container may further comprise;

exchanging means for enabling the ink absorber received in the waste ink chamber to be exchanged with another one.

The exchanging means may comprise a window portion detachably fitted to a wall defining the waste ink chamber.

The window portion may be made of a transparent material.

A container may further comprise;

wiping means for wiping out an ink discharging plane having the ink discharging orifices formed thereon when the ink jet cartridge is released from the firmly held state at the predetermined position.

In the second aspect of the present invention, a container for storably receiving an ink jet cartridge including a recording head section for discharging ink from a plurality of ink discharging orifices and an ink storing section having ink to be fed to the recording head section the ink storing section being integrated with the ink recording head section, the container comprise;

a) a case main body comprises, i) holding means for firmly holding the ink jet cartridge at a predetermined position in the container, ii) capping means for sealably covering the ink discharging orifices therewith while the ink jet cartridge is storably received at the predetermined position in the container, iii) pumping means for sucking ink through the ink discharging orifices while the orifices are sealably covered with the capping means and discharging the sucked ink and, iv) storing means for storing the discharged ink by at least the pumping means, b) a case cover adapted to be turnably opened and closed relative to the case main body, and c) connecting means for operatively connecting the pumping means to the case cover.

Here, a container may further comprise;

wiping means for wiping out an ink discharging plane having the ink discharging orifices formed thereon when the ink jet cartridge is released from the firmly held state at the predetermined position.

The wiping means may comprise a wiping blade disposed above the capping means.

The ink storing means may comprise a waste ink chamber defined in the container and an ink absorber received in the waste ink chamber, the wiping blade coming in contact with the ink absorber.

The waste ink chamber may be defined by the container main body, an intermediate cover fitted to the container main body, and a cylinder member secured to the intermediate cover.

The pumping means may comprise the cylinder member, a piston adapted to be slidably displaced in the cylinder member, and a piston rod extending through the intermediate cover while the slidable displacement of the piston rod is adequately guided.

The connecting means may comprise releasing means for releasing the connecting means from the connected state when a very large magnitude of force is applied to the connecting means.

The connecting means may further comprise shifting means for selectively shifting the connected state to the disconnected state and vice versa.

The intermediate cover may be attachable to and detachable from the container main body.

The capping means may be communicated with a pumping chamber of the pumping means via an orifice formed through a side wall of a cylinder member of the pumping means.

The case cover may be turnably connected to the case main body to turn about a hinge pin, the cover case being displaceable within a certain allowable range in the direction at a right angle relative to the axis line of the hinge pin.

In the third aspect of the present invention, a method of exchanging an ink jet cartridge for an ink jet recording apparatus with another one, the ink jet recording apparatus serving to perform a series of recording operations with the ink jet cartridge mounted thereon, the ink jet cartridge including a recording head section for discharging ink from a plurality of ink discharging orifices and an ink storing section having ink to be fed to the recording head section wherein a container for storably receiving the ink jet cartridge therein comprises;

a) a case main body comprises, i) holding means for firmly holding the ink jet cartridge at a predetermined position in the container, ii) capping means for sealably covering the ink discharging orifices therewith while the ink jet cartridge is storably received at the predetermined position in the container, iii) pumping means for sucking ink through the ink discharging orifices while the orifices are sealably covered with the capping means and discharging the sucked ink and, iv) storing means for storing the discharged ink by at least the pumping means, b) a case cover adapted to be turnably opened and closed relative to the case main body, and c) connecting means for operatively connecting the pumping means to the case cover, the method comprising;

a step of dismounting the ink jet cartridge from the ink jet recording apparatus, a step of storably receiving the dismounted ink jet cartridge in the container, a step of activating the ink jet cartridge by turnably opening the case cover of the container, a step of taking the ink jet cartridge out of the container after completion of the activating operation, and a step of mounting the ink jet cartridge on the ink jet recording apparatus again after it is taken out from the container.

An assembly of the ink jet cartridge and the container may be prepared corresponding to each color to be employed for each recording operation to be performed by the ink jet recording apparatus.

Other objects, features and advantages of the present invention will become apparent from reading of the following description which has been made in conjunction with the accompanying drawings.

DESCRIPTION OF THE PREFERRED EMBODIMENTS

The present invention will now be described in detail hereinafter with reference to the accompanying drawings which illustrate preferred embodiments thereof.

First, a container for storably receiving an ink jet cartridge for an ink jet recording apparatus according to a first embodiment of the present invention will be described below with reference to FIG. 1.

Figure 1:
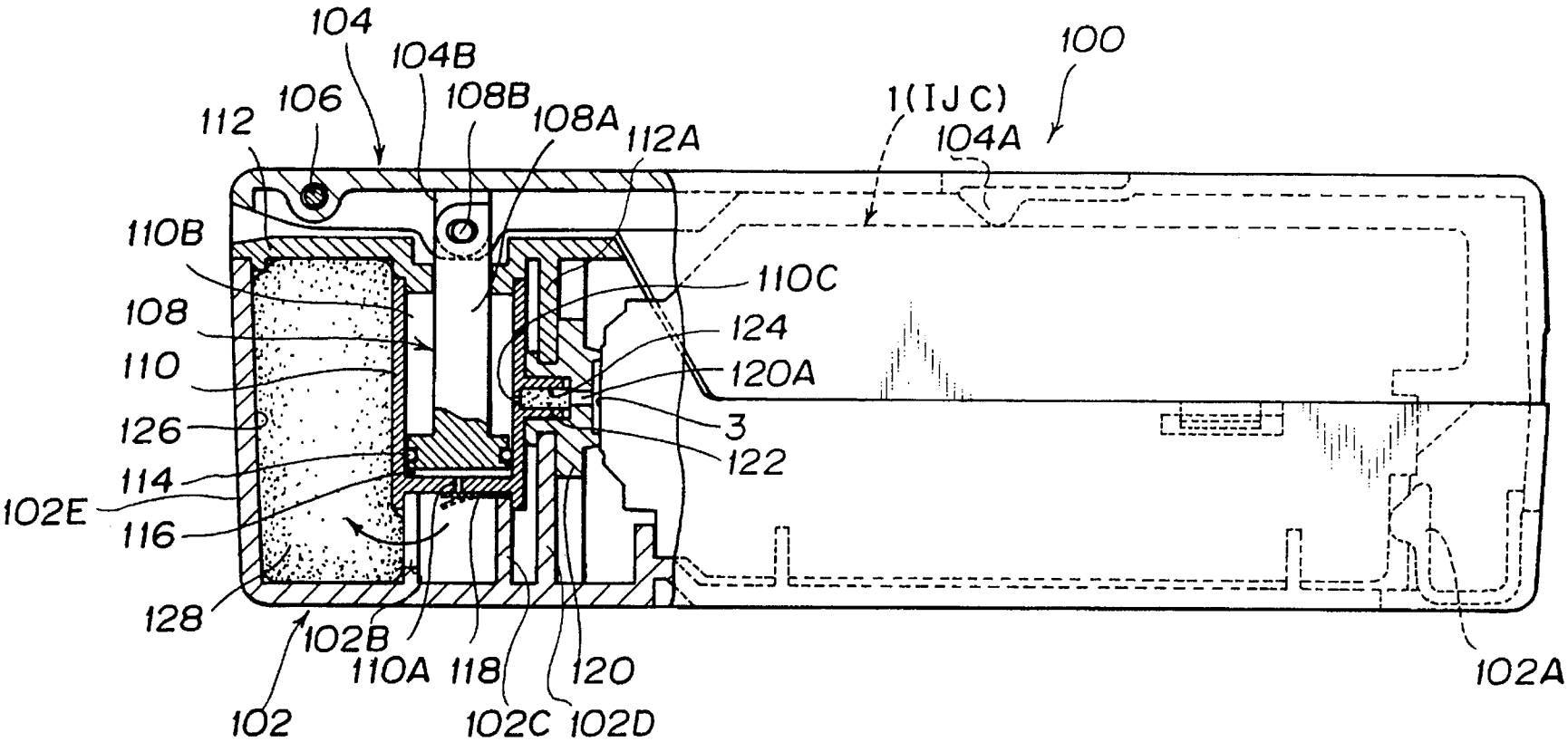
FIG. 1 is a partially exploded side view of a container for storably receiving an ink jet cartridge for an ink jet recording apparatus according to a first embodiment of the present invention.

In FIG. 1, the container is generally designated by reference numeral 100. When an ink jet cartridge 1 is received in the container 100, it is firmly retained at a predetermined position in the container 100 while an ink discharging plane 3 of a recording head unit is held in the capped state. As a case cover 104 to be described later is turnably opened for the purpose of taking the ink jet cartridge 1 out of the container 100, a pumping operation is performed for activating the ink jet cartridge 1 by sucking ink from the ink discharging plane 3. In FIG. 1, reference numeral 102 designates a case main body of the container 100 (hereinafter referred to simply as a case), reference numeral 104 designates a case cover adapted to be turnably opened and closed, and reference numeral 106 designates a hinge pin for turnably holding the case cover 104 so as to allow the latter to be opened and closed by turning it thereabout on the case 102. Reference numeral 102A designates a leaf spring molded integral with the case 102 for normally biasing the ink jet cartridge 1 toward a cap member 120 to be described later by the resilient force thereof, and reference numeral 104A designates a leaf spring molded integral with the case cover 104 for normally biasing the ink jet cartridge 1 toward the bottom surface of the case 102 by the resilient force thereof after the case cover 104 is kept closed. Reference numeral 108. designates a piston member for performing a pumping operation for the purpose of activating the ink jet cartridge 1 in operative association with turnable opening/closing of the case cover 104 as will be described later, and reference numeral 104B designates a bracket extending downward from the lower surface of the case cover 104 to be operatively connected to a pin 108B disposed on at the uppermost end of a rod portion 108A of the piston member 108 (hereinafter referred to simply as a joint pin).

In addition, reference numeral 110 designates a cylinder member immovably held between an intermediate case cover 112 and ribs 102B and 102C of the case 102, reference numeral 114 designates an O-ring liquidtightly fitted around the outer periphery of the piston member 108, reference numeral 116 designates a pumping chamber, reference numeral 110A designates a valve hole formed through the bottom wall of the cylinder member 110 for draining ink outside of the cylinder member 110 therethrough, reference numeral 118 designates a check valve made of an elastic material so as to allow it to be opened only when a positive pressure prevails in the pumping chamber 116, and reference numeral 120 designates a cap member immovably held between a rib 102D of the case 102 and a rib 112A of the intermediate case cover 112 so as to come in close contact with the ink discharging plane 3 of the recording head unit on the ink jet cartridge 1 received in the container 100 as shown in the figure.

Figure 2:
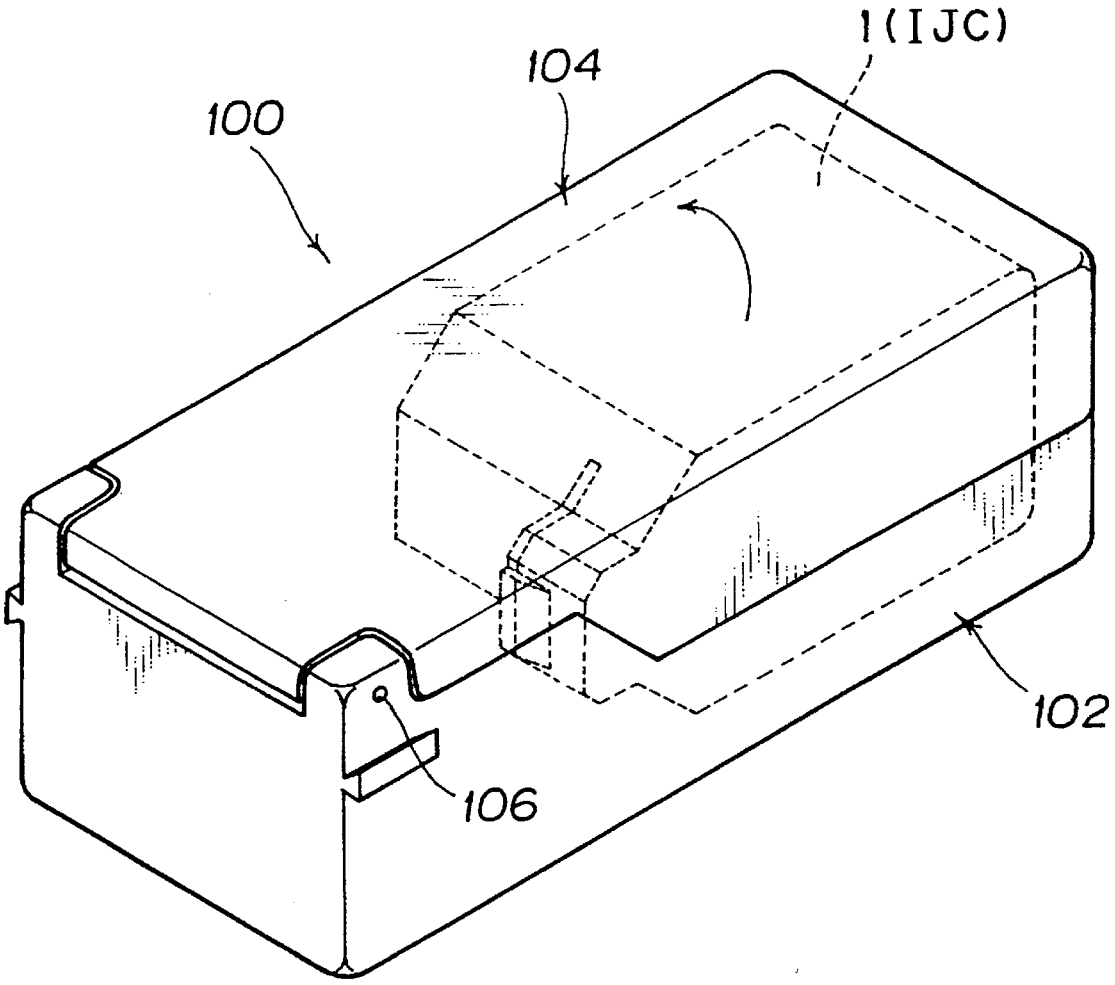
FIG. 2 is a perspective view of the container shown in FIG. 1, particularly showing an appearance of the container.

An ink path 120A is formed in the cap member 120 so that the ink discharged through a plurality of ink discharging orifices 4 on the ink discharging plane 3 is conducted through the ink path to an ink absorbing chamber 124 having an ink absorber 122 received therein. In addition, an orifice 110C is formed between the ink absorbing chamber 124 and a cylinder chamber 110B of the cylinder member 110, i.e., through the side wall of the cylinder member 110 so that the ink conducted to the ink absorbing chamber 124 is conducted further through the orifice 110C to the pumping chamber 116 side. Reference numeral 126 designates a waste ink chamber in which the waste ink drained from the pumping chamber 116 through the valve hole 110A is stored, and reference numeral 128 designates an ink absorber received in the waste ink chamber 126. Incidentally, FIG. 2 shows by way of perspective view an appearance of the container 100.

With the container 100 constructed in the above-described manner, the cap member 120 is brought in close contact with the ink discharging plane 3 of the recording head unit on the ink jet cartridge 1, which has been received in the container 100, by the resilient force of the leaf spring 102A while no ink is used or while an ample quantity of ink is left unused in the ink jet cartridge 1 because the latter is detached from an ink jet recording apparatus in the course of recording operations.

When the ink jet cartridge 1 is taken out of the container 100 for reuse thereof, first, the case cover 104 is turnably opened by turning it about the hinge pin 106, causing the piston member 108 to be raised up in the cylinder chamber 110B until the pumping chamber 116 is enlarged positionally in excess of the orifice 110C. At this time, since the check valve 118 is kept closed so that the valve hole 110A is closed with the check valve 118, a negative pressure prevails in the pumping chamber 116. Thus, ink can be conducted from the ink discharging orifices 4 on the ink discharging plane 3 of the recording head unit on the ink jet cartridge 1 to the pumping chamber 116 side via the ink path 120A, the ink absorbing chamber 124 and the orifice 110C under the influence of the negative pressure in the pumping chamber 116.

After the ink jet cartridge 1 is taken out of the case 102, the case cover 104 is turnably closed to restore the original state, causing the piston member 108 to be lowered. The ink conducted to the pumping chamber 116 (i.e., the ink forcibly discharged from the ink jet cartridge 1 by the activation of the latter achieved by the pumping operation) can be conducted further to the waste ink chamber 126 while the check valve 118 is kept opened.

In the case that it is anticipated that the activation of the ink jet cartridge 1 is insufficiently achieved merely by a single pumping operation, it is recommendable that pumping operations, i.e., turnable opening/closing of the case cover 104 are repeatedly performed several times before the ink jet cartridge 1 is taken out of the case 102. It should be noted that an activating operation and a capping operation are performed for the ink jet cartridge 1 every time the latter is repeatedly received in and taken out of the container 100. Thus, since the ink jet cartridge 1 is already activated in the above-described manner when it is taken out of the container 100 and then mounted on a carriage HC of the ink jet recording apparatus, there does not arise a necessity that an activating or a recovering operation is performed for the ink jet cartridge 1 on the ink jet recording apparatus side. For this reason, in contrast with the conventional ink jet recording apparatus, it is not required that an activating operation is performed for the ink jet cartridge 1 immediately after the latter is mounted on the carriage of the ink jet recording apparatus even though a recovery unit is arranged on the ink jet recording apparatus side.

Figure 3:
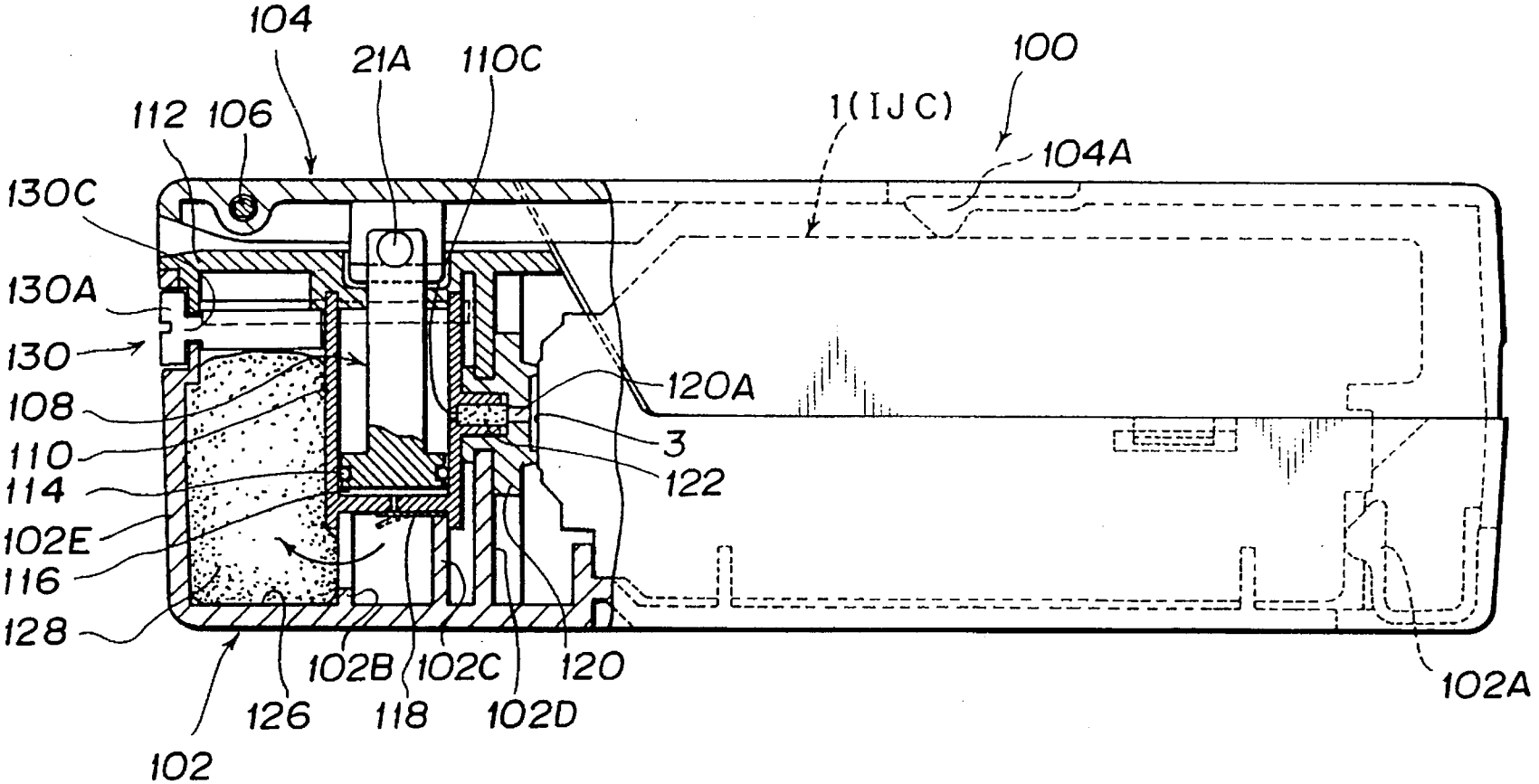
FIG. 3 is a partially exploded side view of a container for storably receiving an ink jet cartridge for an ink jet recording apparatus according to a second embodiment of the present invention.
Figure 4:
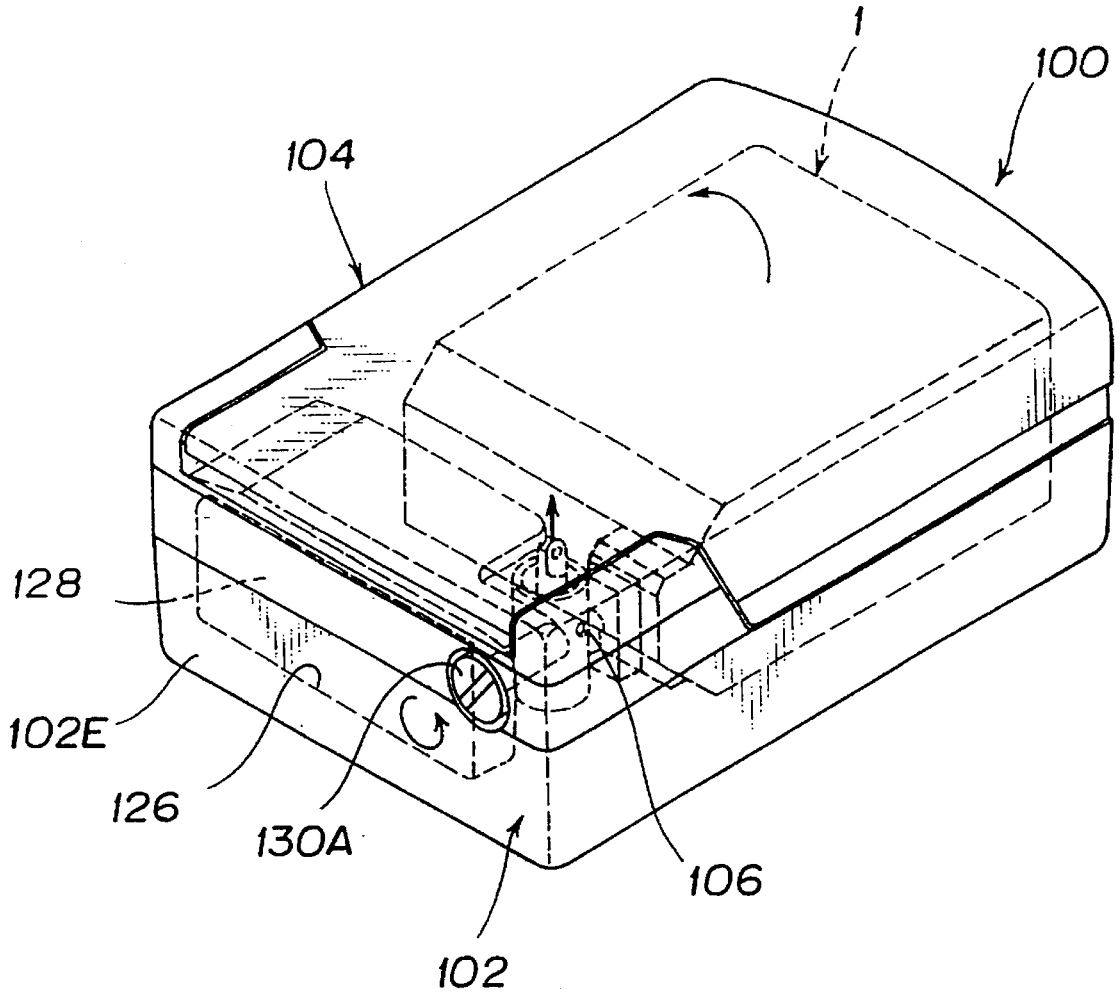
FIG. 4 is a perspective view of the container shown in FIG. 3

Next, a container for storably receiving an ink jet cartridge for an ink jet recording apparatus according to a second embodiment of the present invention will be described below with reference to FIGS. 3 to 5. The same components as those in the first embodiment are represented by like reference numerals, and repeated description of these components is omitted neglected for the purpose of simplification.

In this embodiment, an intermediate case cover 112 is fused or welded to a case 102 or secured to the same using an adhesive. A cylinder member 110, a piston member 108 slidably received in the piston member 110 and a cap member 120 are retained between the intermediate case cover 112 and the case 102. In addition, a waste ink chamber 126 is likewise formed between the intermediate case cover 112 and the case 102.

Figure 5A:
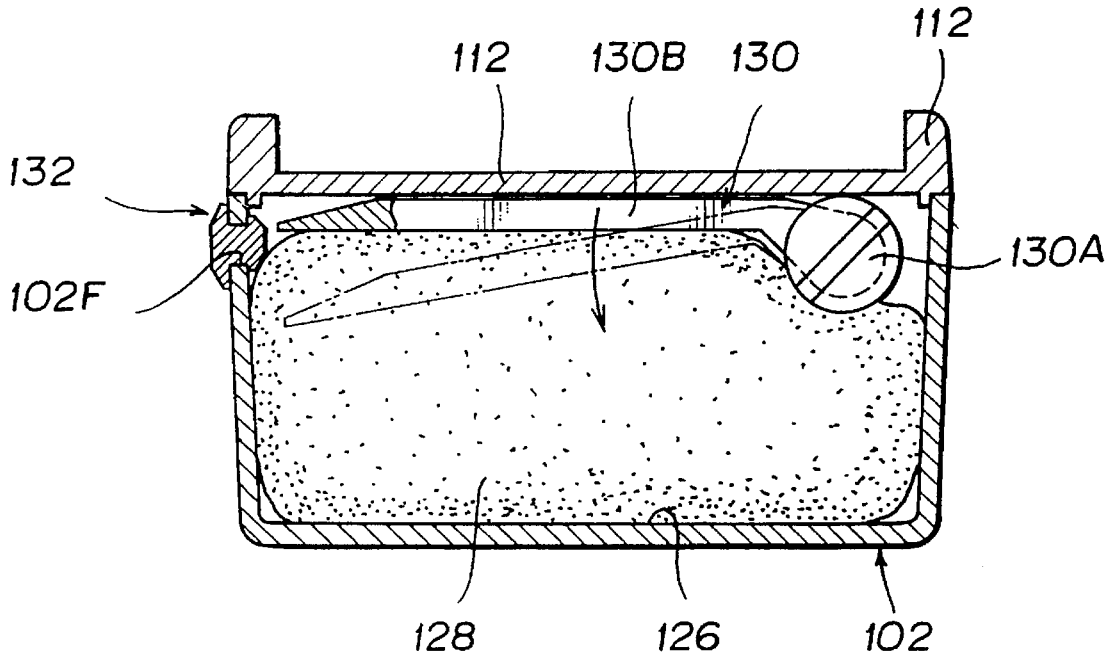
FIG. 5A is a cross-sectional view of the container shown in FIG. 3, particularly showing the structure of an; ink absorber squeezing member.

A characterizing feature of this embodiment consists in that a pin-shaped knob 130A is exposed outside of a side wall 102E of the case 102 located adjacent to the waste ink chamber 126. An ink absorber squeezing member 130 is turnably supported by the knob 130A so as to enable an ink absorber 128 received in the waste ink chamber 126 to be squeezed with the squeezing member 130 by turning the knob 130A in the counterclockwise direction (see FIGS. 5A and 5B) with the aid of a coin inserted into a slit formed on the knob 130A from the outside. As shown in FIG. 5A, the squeezing member 130 is composed of an assembly of the knob 130A and a squeezing plate 130B integrated there with, and a shaft portion 130C (see FIG. 3) of the knob 130A is liquid-tightly supported by the side wall 102E of the case 102. In FIG. 5A, reference numeral 132 designates a sealing plug molded of an elastic material or the like. Normally, an ink drain port 102F is liquid-tightly closed with the sealing plug 132.

With the container 100 constructed in the above-described manner, as a case cover 104 is turnably raised up to turn about a hinge pin 106 in the counterclockwise direction, the piston member 108 operatively connected to the case cover 104 is raised up so that a negative pressure appears in a pumping chamber 116. While the case cover 104 is kept open, the ink jet cartridge 1 is received in the container 100, and subsequently, the ink discharging plane 3 of the recording head unit on the ink jet cartridge 1 is brought in close contact with the cap member 120 by the resilient force of the leaf spring 102A.

When the ink jet cartridge 1 is taken out of the container 100, the case cover 104 is turnably opened, causing ink to be discharged from the ink jet cartridge 1 into the pumping chamber 116, because the latter is held in the negative pressure state. After the ink jet cartridge 1 is taken out of the container 100, the case cover 104 is turnably closed so that the piston member 108 is lowered and the check valve 118 is opened, whereby the ink remaining in the pumping chamber 116 is drained into the waste ink chamber 126 through the check valve 118 which is kept open at this time.

As the ink jet cartridge 1 is repeatedly activated and ink is then discharged therefrom every time it is received in and taken out of the container 100, the waste ink chamber 126 is fully filled with ink. In this embodiment, when it is determined that the waste ink chamber 126 is completely or substantially filled with ink, the sealing plug 132 is first disconnected from the ink drain port 102F, the container 100 is then inclined such that the ink drain port 102F is possibly oriented in the downward direction, and thereafter, the ink absorber 128 is compressed and squeezed by turning the squeezing member 130 in the counterclockwise direction as represented phantom lines in FIG. 5A so as to allow the ink remaining in the waste ink chamber 126 to be drained outside of the container 100.

Figure 5B:
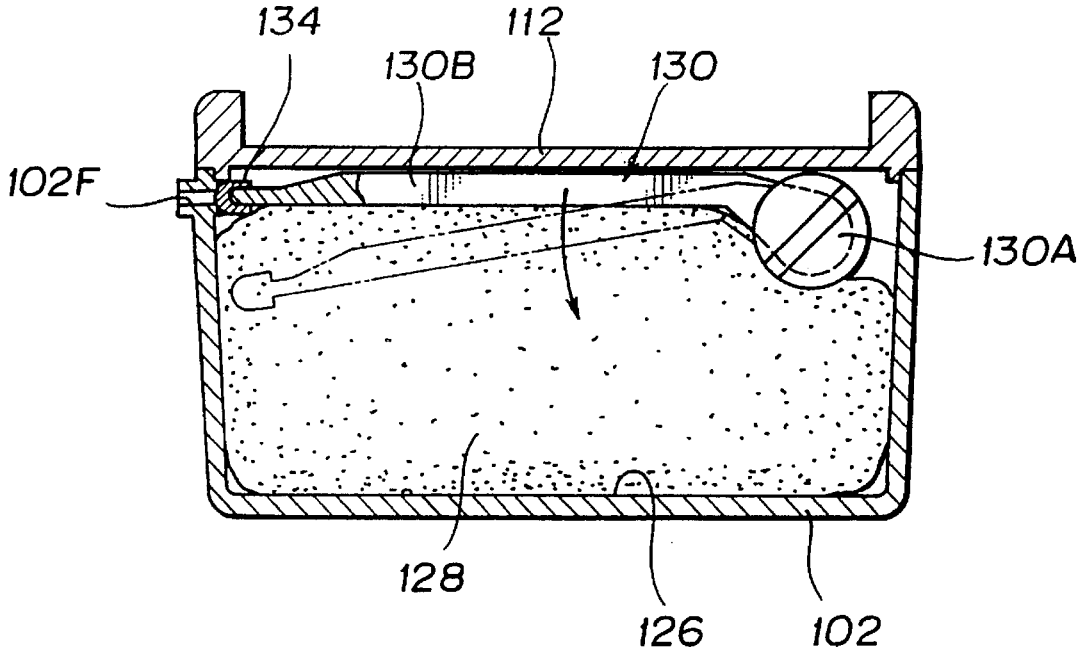
FIG. 5B is a cross-sectional view of the container shown in FIG. 3, particularly showing the structure of an other ink absorber squeezing member.

FIG. 5B shows by way of cross-sectional view the structure of another squeezing member modified from the squeezing member 130 shown in FIG. 5A. As is apparent from FIG. 5B, an ink drain port 102F formed through the side wall of the waste ink chamber 126 is liquid-tightly closed with an elastic plug 134 fitted to the foremost end of the squeezing member 130. While the squeezing member 130 is not actuated, the ink drain port 102F is liquidtightly closed with the plug 134. When the squeezing member 130 is turnably actuated in the counterclockwise direction, the ink squeezed out of the ink absorber 128 can easily be drained through the ink drain port 102F because the plug 134 is easily disengaged from the ink drain port 102F by the elastic deformation thereof.

As described above, in this embodiment, since the squeezing member 130 is turnably actuated from the outside to compress or squeeze the ink absorber 128 therewith, the container 100 can continuously be used by draining the ink remaining in the waste ink chamber 126 through the ink drain port 102F regardless of how the ink absorber 128 is filled with ink.

The second embodiment of the present invention has been described above with respect to a container for storably receiving an ink jet cartridge for an ink jet recording apparatus wherein the container includes a waste ink chamber. However, it is obvious that the present invention may equally be applied to the case that the ink jet recording apparatus includes a waste ink chamber together with a recovery unit for the ink jet cartridge and a squeezing member is arranged for compressing or squeezing an ink absorber received in the waste ink chamber. In addition, in this embodiment, the turnable squeezing member is employed for the waste ink chamber. However, the present invention is not limited only to this arrangement. Alternatively, a rod-shaped squeezing member may be substituted for the turnable squeezing member. Any type of squeezing member may be employed for the waste ink chamber, provided that it is proven that the ink absorber received in the waste ink chamber can reliably be deformed by the squeezing member and the waste ink chamber has a drain port.

Figure 6:
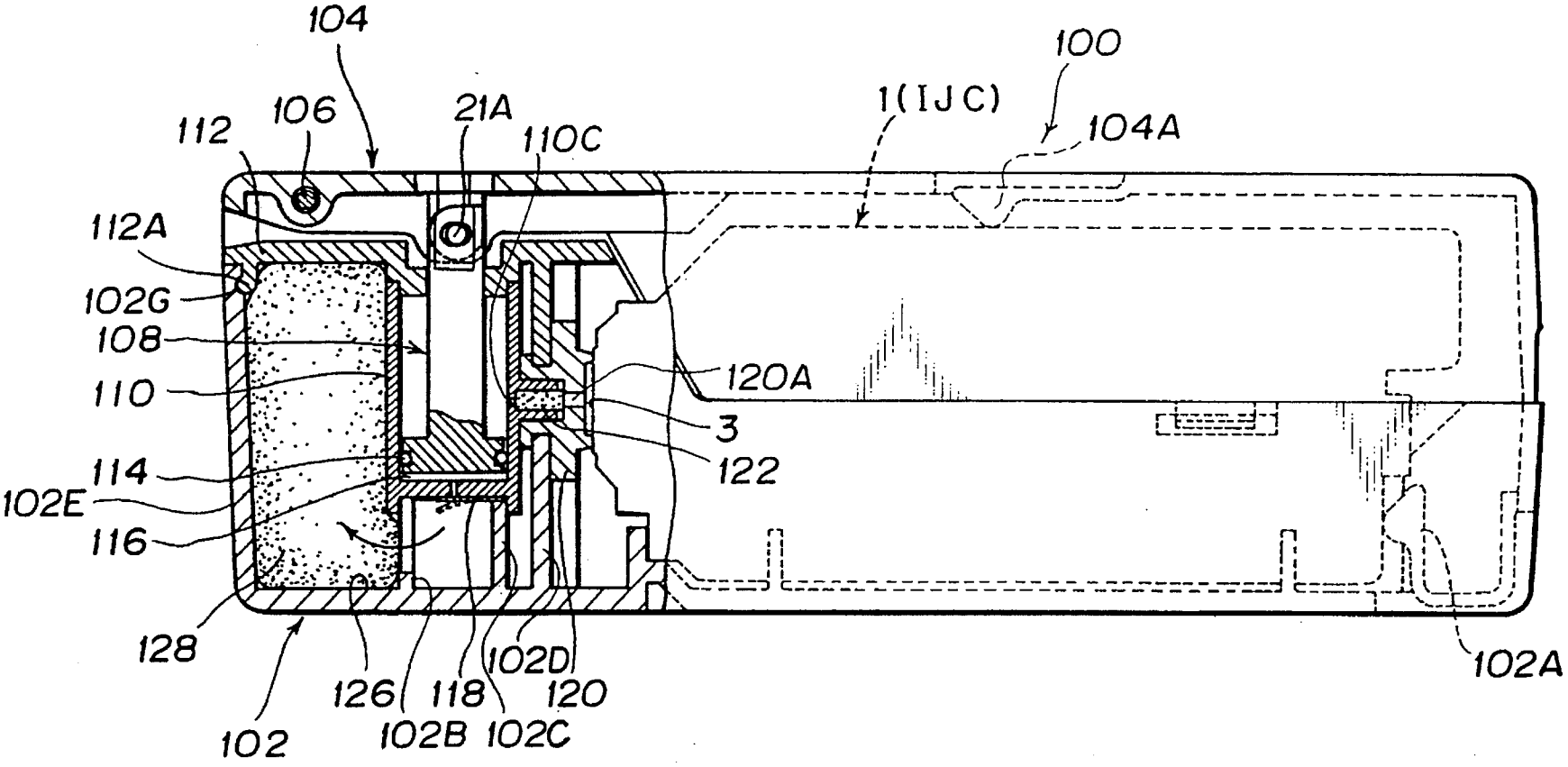
FIG. 6 is a partially exploded side view of a container for storably receiving an ink jet cartridge for an ink jet recording apparatus according to a third embodiment of the present invention.

Next, a container for storably receiving an ink jet cartridge according to a third embodiment will be described below with reference to FIG. 6.

A characterizing feature of this embodiment consists in that an intermediate case cover 112 is attachable to and detachable from the case 102 of the container 100. In this figure, reference numeral 112A designates an engagement lip which extends around a part of the intermediate case cover 112 corresponding to an engagement groove 102G formed on the waste ink chamber 126 while maintaining liquid-tightness between an intermediate case cover 112 and the waste ink chamber 126. Since the case 102 and the intermediate case cover 112 are molded of an elastic synthetic resin, the engagement lip 112A can exhibit an elasticity by molding it integral with the intermediate case cover 112. The engagement groove 102G having a sectional shape corresponding to that of the engagement lip 112 is formed around the upper periphery of the waste ink chamber 126. The case cover 104 is detachably fitted to the intermediate case cover 112 through a supporting bracket (not shown) integrated with the intermediate case cover such that it is turnably opened and closed by turning about a hinge pin 106.

In this embodiment, the intermediate case cover 112 is removed from the case 102 in good time when the waste ink chamber 126 is fully filled with ink so that the ink absorber 128 received in the waste ink chamber 126 can be exchanged with a new one. In the case of this embodiment, since the intermediate case cover 112 is jointed to the case cover 104 via an assembly of the case cover 104 and the piston member 108, as the intermediate case cover 112 is removed from the case 102, the piston member 108 is drawn out of the cylinder member 110 so that the case cover 104 is removed from the case 102 together with the piston member 108. To assure that liquid-tightness is maintained between the intermediate case cover 112 and the case 102, engagement means is utilizing the elastic deformation of the elastic synthetic resins. When the intermediate case cover 112 is fitted to the case 102, a series of operations are performed in the reverse order of the above described operations so that the container 100 is assembled with the case cover 104 again to build an integral structure.

Figure 7:
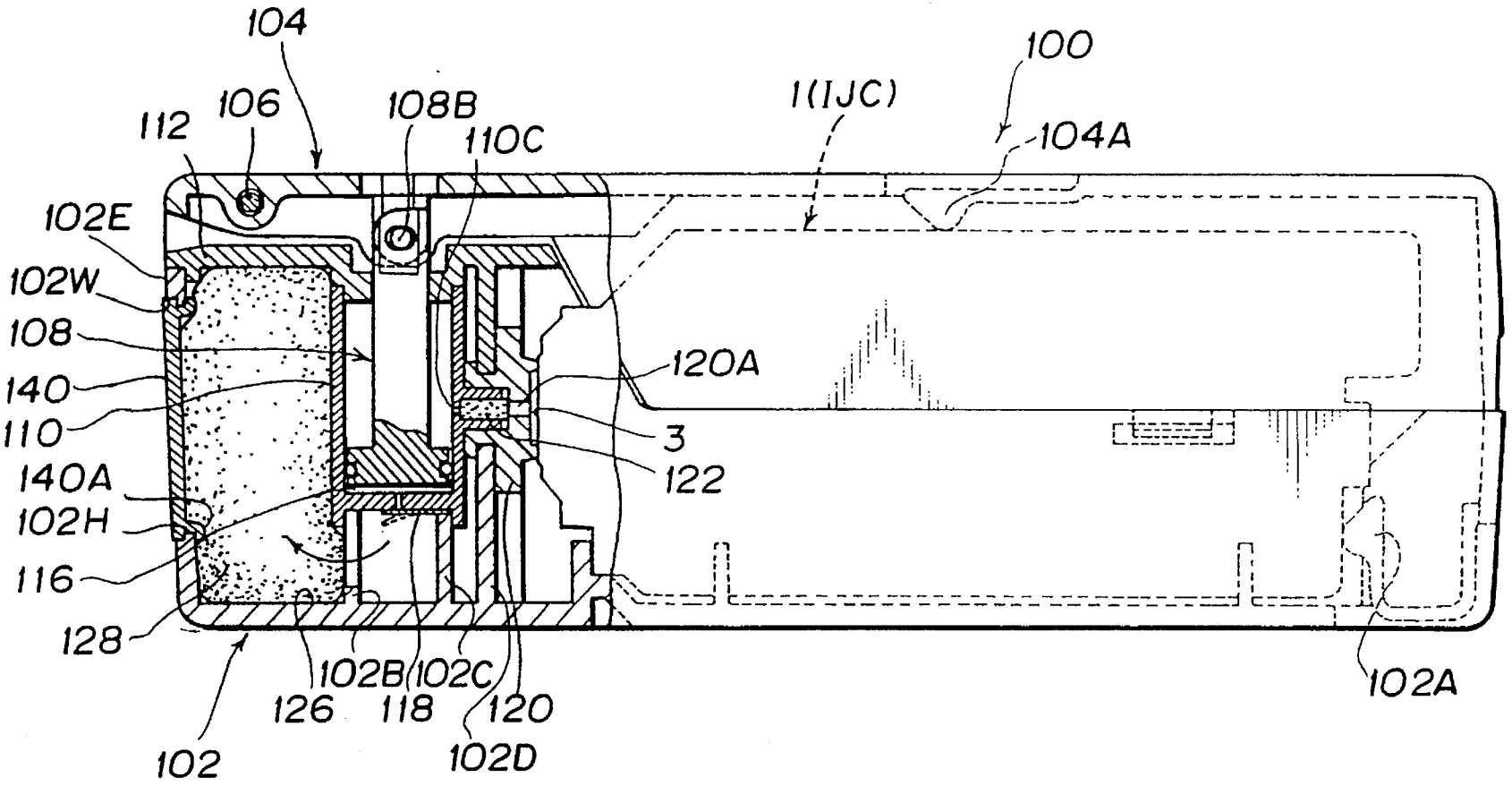
FIG. 7 is a partially exploded side view of a container for storably receiving an ink jet cartridge for an ink jet recording apparatus according to a fourth embodiment of the present invention.

Next, a container for an ink jet cartridge according to a fourth embodiment of the present invention will be described below with reference to FIG. 7.

In this embodiment, in contrast with the container disclosed in the preceding embodiments wherein the waste ink chamber 126 is prepared in the form of an independent section by fusing or adhesively connecting the intermediate case cover 112 to the case 102, a window 102W is formed to a case side wall 102E constituting the waste ink chamber 126 so as to allow an ink absorber 128 to be taken out of the waste ink chamber 126 through the window 102W, and an attaching/detaching window lid 140 molded of an elastic synthetic resin is fitted to the window 102W by utilizing the elastic deformation thereof. Since the attaching/detaching window lid 140 is likewise molded of an elastic synthetic resin, liquid-tight engagement can be established between the window lid 140 and the case 102. In this FIG. 140A designates an engagement lip for the window lid 140A, and reference numeral 102H designates an engagement frame portion extending around the periphery of the window 102W. As is apparent from the above description, when the attaching/detaching window lid 140 is molded of a transparent elastic synthetic resin, it is possible to visually recognize through the window lid 140 how much the waste ink chamber 126 is filled with ink.

Next, a container according to a fifth embodiment of the present invention will be described below with reference to FIG. 8.

Figure 8:
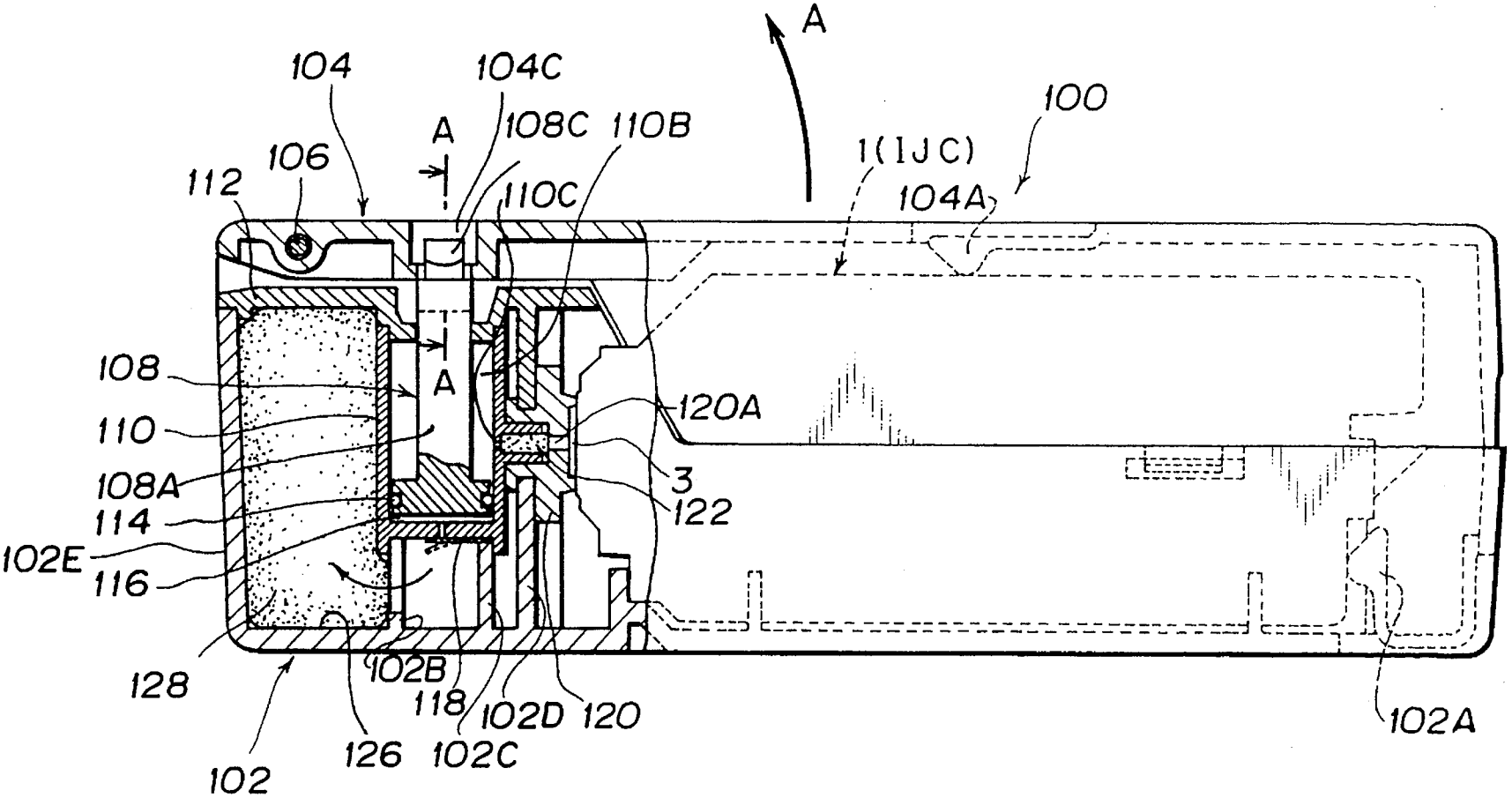
FIG. 8 is a partially exploded side view of a container for storably receiving an ink jet cartridge for an ink jet recording apparatus according to a fifth embodiment of the present invention.
Figure 9A:
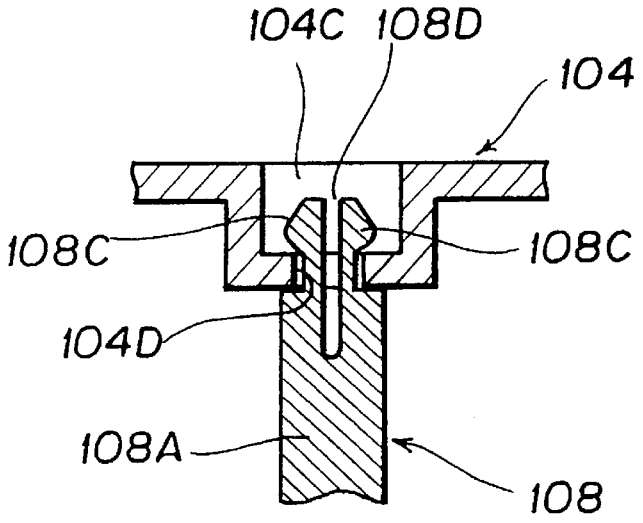
FIG. 9A is a fragmentary cross-sectional view of the container taken along line A—A in FIG. 8, particularly showing the structure of a joint portion of the container relative to a case cover on an enlarged scale.

In FIG. 8, reference numeral 108A designates a rod portion for a piston member 108, reference numeral 108C designates a joint pawl formed at the upper most end part of the rod portion 108A, and reference numeral 108D, as shown in FIG. 9A, designates a slit cut out downward of the uppermost end of the rod portion 108A in the axial direction. In addition, reference numeral 104C designates a recess formed in the case cover 104 so as to allow the piston member 108 to be operatively jointed to the case cover 104. A joint hole 104D is formed through the bottom wall of the recess 104C. As shown in FIG. 8, the lower surface of the joint pawl 108C exhibits an arc-shaped contour, and as is best seen in FIG. 9A, a sectional contour of the joint pawl 108C extends in the smoothly curved state. The lower end of the joint pawl 108C is engaged with an upper edge of the joint hole 104D as shown in FIG. 9A.

With the container 100 constructed in the above-described manner, when the case cover 104 is turnably opened by turning about the hinge pin 106 in the A arrow-marked direction in FIG. 8, the piston member 108 is raised up in the cylinder chamber 110B of the cylinder member 110 while it comes in tangential contact with the upper edge of the joint hole 104D formed through the case cover 104. Since the contact point of the joint pawl 108C is permitted to slightly move in parallel with the plane of FIG. 8 while coming in arc-shaped contact with the bottom surface of the recess 104C of the case cover 104, a very large magnitude of interference force is not applied to the components associated with the joint pawl 108C and the case cover 104 until the rod portion 108A is raised up in excess of a predetermined position.

Next, a container according to a sixth embodiment of the present invention will be described below with reference to FIG. 9B which shows by way of fragmentary sectional view the structure of a pair of joint pawl halves on an enlarged scale. In contrast with the fifth embodiment of the present invention shown in FIG. 9A wherein a pair of engagement pawl halves 108C are outwardly oriented with the slit 108D located therebetween and the arc-shaped lower surface of the pawl 108C comes in tangential contact with the upper edge of the joint hole 104D, in this embodiment, a pair of joint pawl halves 108C are inwardly oriented while facing to each other. In addition, like the preceding embodiment the lower surface of the joint pawl 108C exhibits an arc-shaped contour as shown in FIG. 8, in this embodiment, an opening portion 104D is formed through the case cover 104 without any formation of a recess and a support beam 104 is bridged below the opening portion 104D so that a pair of joint pawl halves 108C are supported on the support beam 104 while the arc-shaped lower surfaces of the joint pawl halves 108C come in tangential contact with the support beam 104. Incidentally, FIG. 10 shows by way of perspective view an appearance of the container 100 constructed according to the sixth embodiment of the present invention.

Figure 9B:
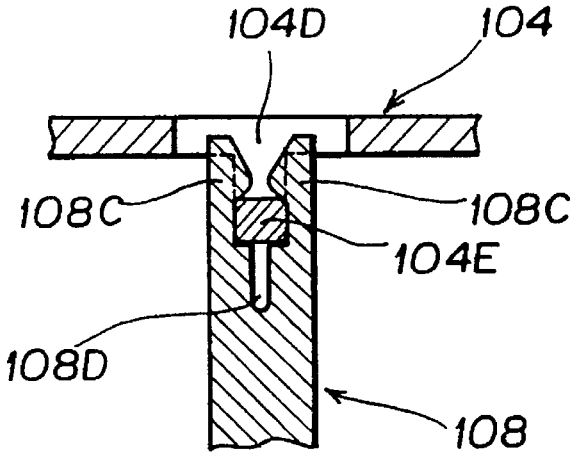
FIG. 9B is a fragmentary cross-sectional view of a container for an ink jet recording apparatus according to a sixth embodiment of the present invention, particularly showing the structure of a joint portion of the container relative to a case cover on an enlarged scale.
Figure 10:
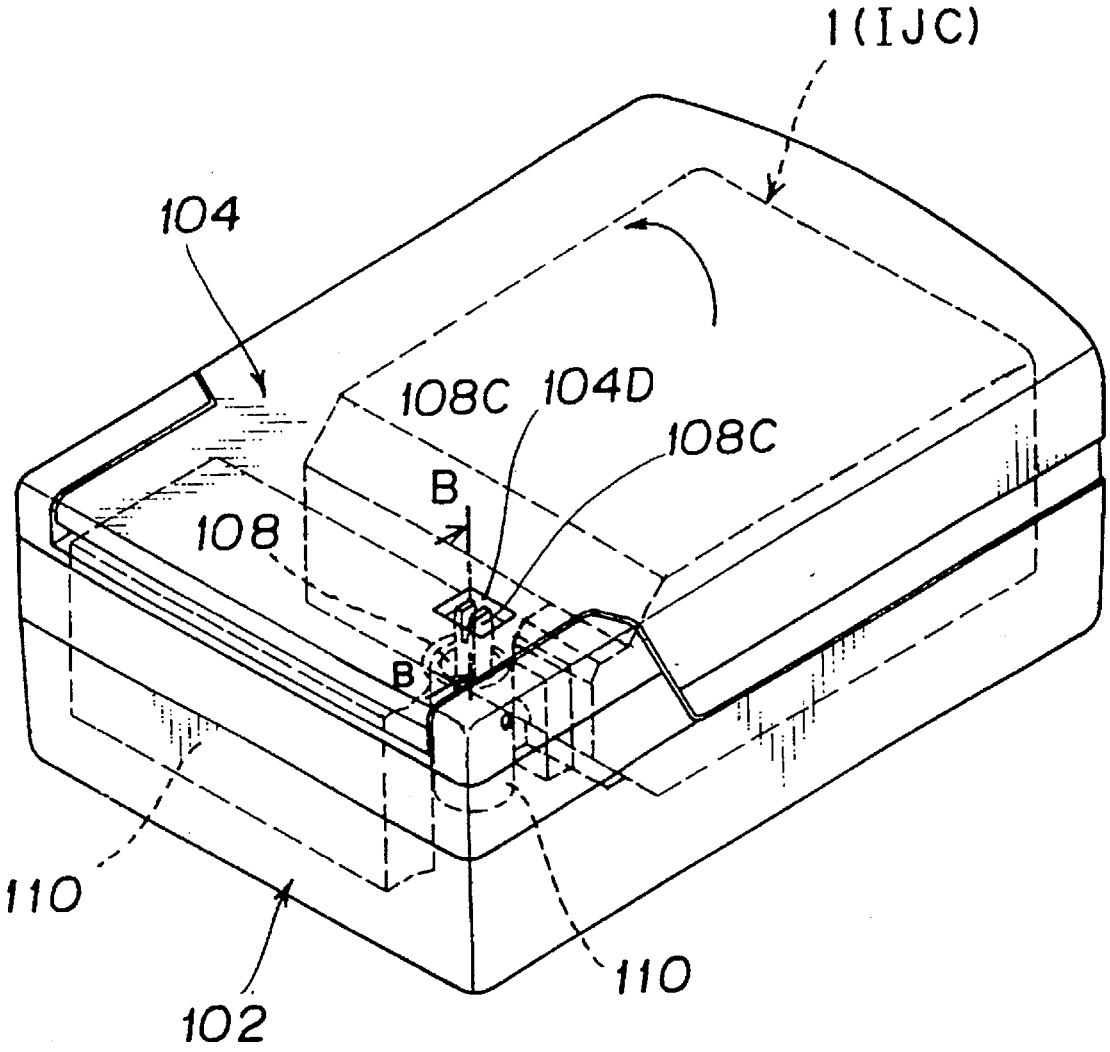
FIG. 10 is a perspective view of the container constructed according to the sixth embodiment of the present invention.

According to the fifth and sixth embodiments of the present invention as described above with reference to FIGS. 8 to 10, as the case cover 104 is turnably opened by turning about the hinge pin 106 in the counterclockwise direction, the piston member 108 is raised up in the upward direction, causing an angle of turning movement of the cover case 104 to be increased, whereby the contact point of joint pawl 108C is slightly displaced in the direction perpendicular to the plane of each of FIG. 9A and FIG. 9B without any application of a very large magnitude of force to the joint portion. If the cover case 104 is turnably opened in excess of a predetermined angle required for achieving a pumping operation and forcible or useless turnable opening movement of the case cover 104 is liable to occur, a force effective for releasing the joint pawl 108C from the engaged state relative to the case cover 104 as shown in FIG. 9A and FIG. 9B is applied to the piston member 108. Owing to the elasticity of the joint pawl 108C having a smooth configuration, in the case shown in FIG. 9A, the joint pawl 108C is caused to deflect in the inward direction, whereas in the case shown in FIG. 9B, it is caused to deflect in the outward direction.

Thus, the piston member 108 is released from the jointed state relative to the case cover 104. On the contrary, when the case cover 104 is turnably closed by turning about the hinge pin 106 in the clockwise direction, the joint pawl 108C can easily be restored to the original jointed state at the time approximately near to the final step of turning movement of the case cover 104 as shown in FIG. 9A and FIG. 9B by utilizing the elasticity of the joint pawl 108C.

Next, a container for storably receiving an ink jet cartridge for an ink jet recording apparatus according to a seventh embodiment of the present invention will be described below with reference to FIG. 11.

Figure 11:
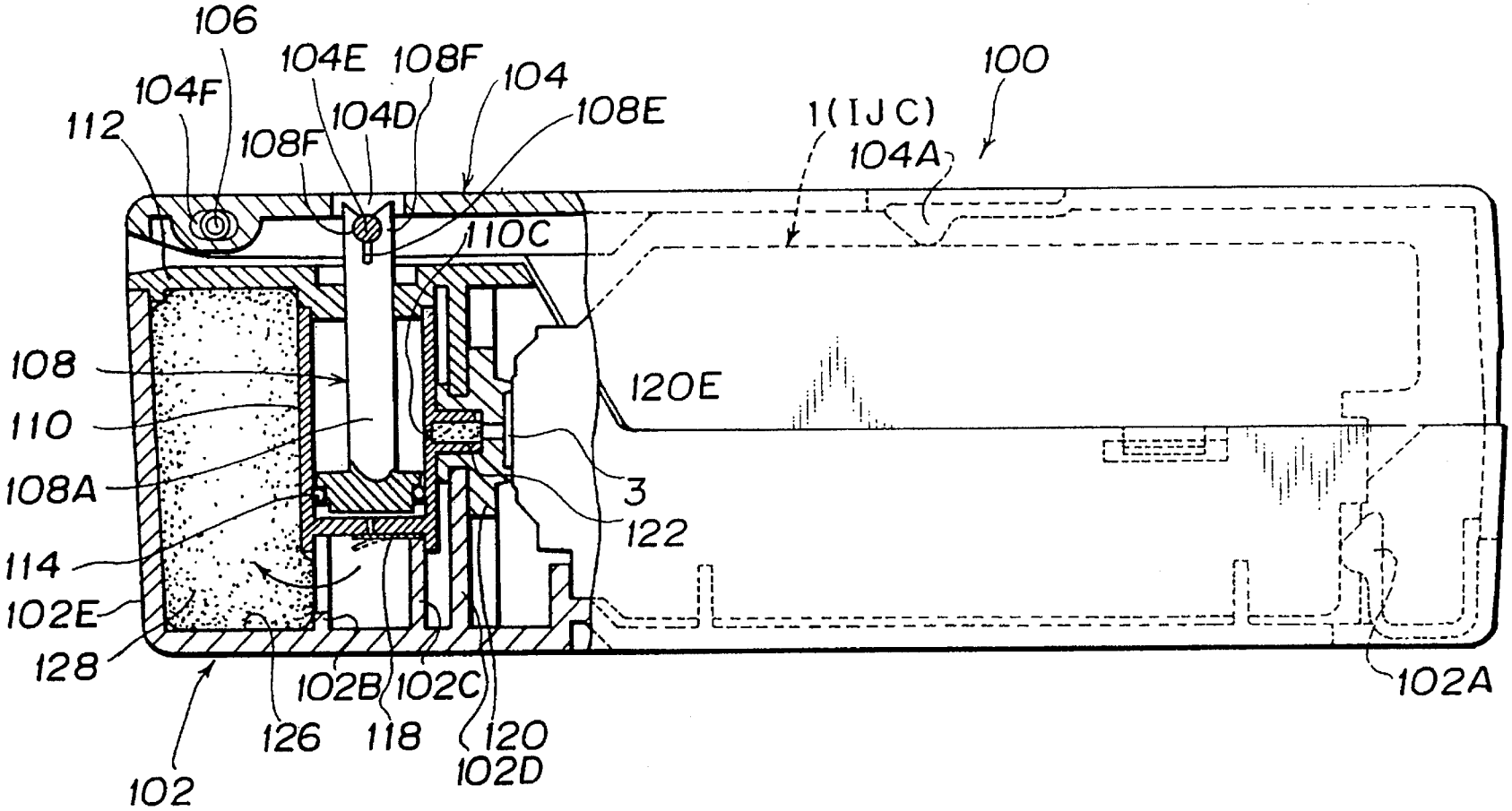
FIG. 11 is a partially exploded side view of a container for storably receiving an ink jet cartridge for an ink jet recording apparatus according to a seventh embodiment of the present invention.

A characterizing feature of this embodiment consists in that a differential displacement arising between the case cover 104 and the piston member 108 at the time of turnable opening of the case cover 104 in the direction in parallel with the plane of FIG. 11 is eliminated possibly on the case cover 104 side, and moreover, the piston member 108 is released from the jointed state relative to the case cover 104 in order to assure that a very large magnitude of force is applied to the joint portion therebetween when the case cover 104 is turnably opened by turning about the hinge pin 106 in excess of a predetermined angle. In the figure, reference numeral 104F designates a support hole formed in the shape of a longitudinally extending elongated hole for supporting the hinge pin 106 therein.

In this embodiment, the elongated support hole 104F is formed on the case cover 104 side. Alternatively, an elongated hole of the foregoing type may be formed on the casing 102 side. A support beam 104E is bridged directly below an opening portion 104D formed through the case cover 104 while extending at a right angle relative to the plane of FIG. 11. To reduce the slidable resistance of the support beams 104E in the circumferential direction, the support beam 104E exhibits a circular sectional contour. In the figure, reference numeral 108E designates a slit cut out downward of the uppermost end of a rod portion 108A of the piston member 108, and reference numeral 108F designates a pair of holding arms facing to each other with the slit 108E located therebetween. A part of the arms 108F is designed to exhibits a contour corresponding to the circular sectional shape of the support beam 104E so that the latter is held between the pair of holding arms 108F in the clamped state by utilizing the elasticity of each of the holding arms 108F.

With the container 100 constructed in the above-described manner, as the case cover 104 is turnably opened by turning about the hinge pin 106 in the counterclockwise direction, the piston member 108 is raised up in the upward direction, causing the case cover 104 to be displaced in the elongated support hole 104F at a distance corresponding to the upward stroke of the piston member 108 within the allowable range defined for the case cover 104 by the elongated support hole 104F, whereby a large magnitude of force is not applied to the joint portion between the piston member 108 and the case cover 104. If the foregoing force exceeds a imitatively determined magnitude for some reason, the holding arms 108F are disengaged from the support beams 104E by the elastic deformation of the holding arms 108F so that the support beam 104E is released from the connected state. Subsequently, the case cover 104 can be restored to the original connected state around at the final step of turnable closing of the case cover 104.

Next, a container according to an eighth embodiment of the present invention will be described below with reference to FIG. 12.

A characterizing feature of this embodiment consists in that a wiping unit is arranged in the container 100 in addition to the recovery unit by pumping operation for the ink jet cartridge 1.

In the case that the ink jet cartridge 1 is taken out of the container 100, as the case cover 104 is turnably opened or closed by turning about the hinge pin 106, ink is discharged or sucked through a plurality of ink discharging orifices 4 of the recording head unit on the ink jet cartridge 1 by the pumping operation performed by the piston member 108. Thus, there often may arise a problem that a certain amount of ink remaining on the ink discharging orifices 4 adheres to the ink discharging plane 3 of the recording head unit.

Once the foregoing problem has arisen, drops of ink can fall down on a recording sheet when the ink jet cartridge 1 is mounted on the ink jet recording apparatus. In addition, drops of ink can be scattered away due to their inertia from the ink jet cartridge 1 during an initial scanning operation so that components located in the vicinity of the ink jet cartridge 1 are contaminated with the ink drops. In this embodiment, to prevent the ink drops from being scattered away from the ink jet cartridge 1, the ink discharging plane 3 is wiped in operative association with an operation for taking the ink jet cartridge 1 out of the container 100.

Figure 12:
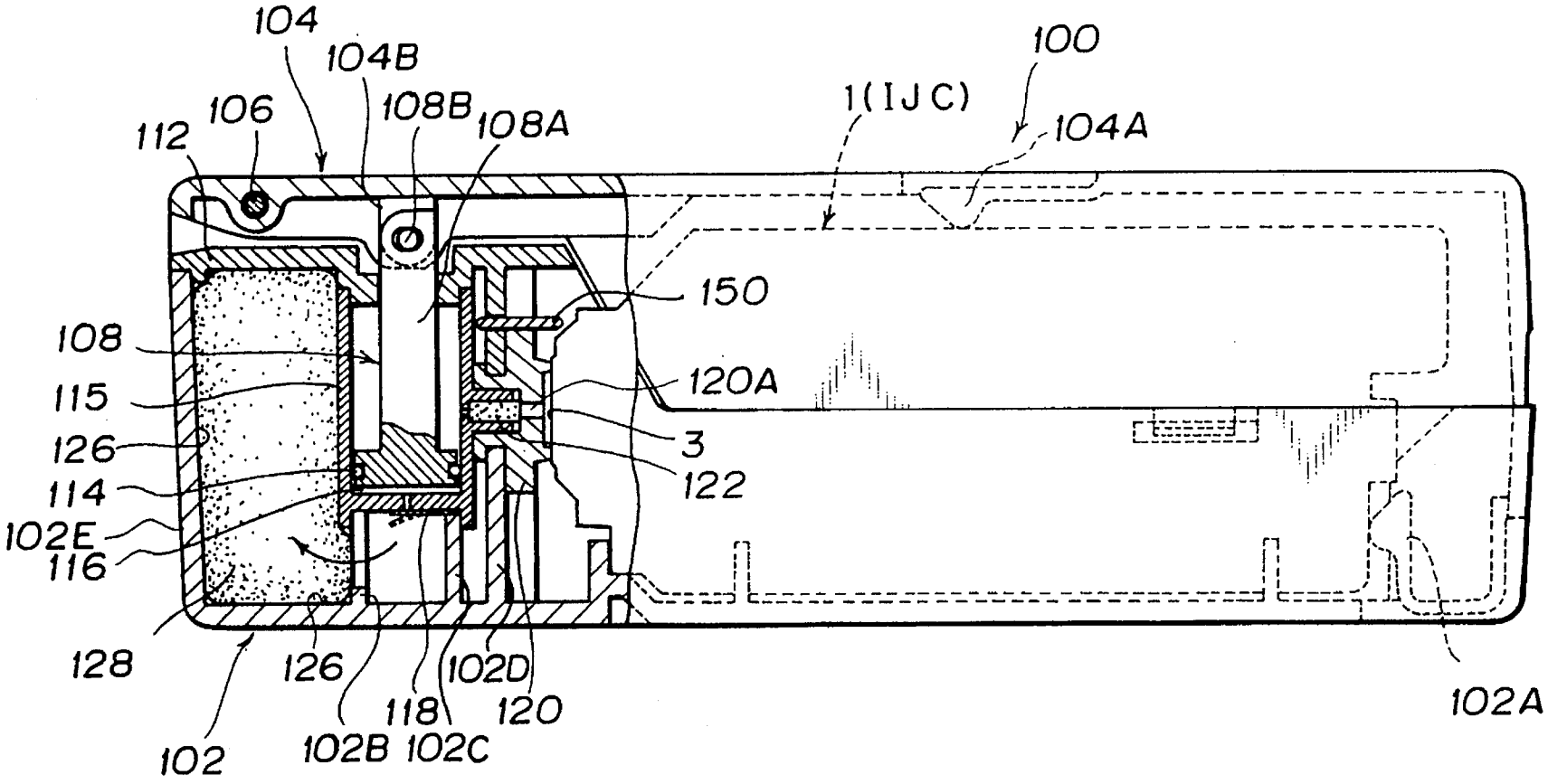
FIG. 12 is a partially exploded side view of a container for storably receiving an ink jet cartridge for an ink jet recording apparatus according to an eighth embodiment of the present invention which further includes a wiping blade in addition to the first embodiment.

In FIG. 12, reference numeral 150 designates a wiping blade disposed on the upper portion of the cap member 120 received in the case 102. It is desirable that the wiping blade 150 is molded of a porous elastic material such as a foamed polyurethane rubber or the like, and the fore end part of the wiping blade 150 is projected outside of the cap member 120 toward the ink discharging plane 3 of the recording head unit on the ink jet cartridge 1. When the ink jet cartridge 1 now in practical use on the ink jet recording apparatus is storably received in the container 100 or when the ink jet cartridge 1 storably received in the container 100 is taken out from the latter for the purpose of reusing thereof, the ink discharging plane 3 is wiped by the wiping blade 150 in operative association with the operation for taking the ink jet cartridge 1 out of the container 100 or receiving the former in the latter, whereby the ink adhering to the ink discharging plane 3 can be wiped out by the wiping blade 150.

Figure 13:
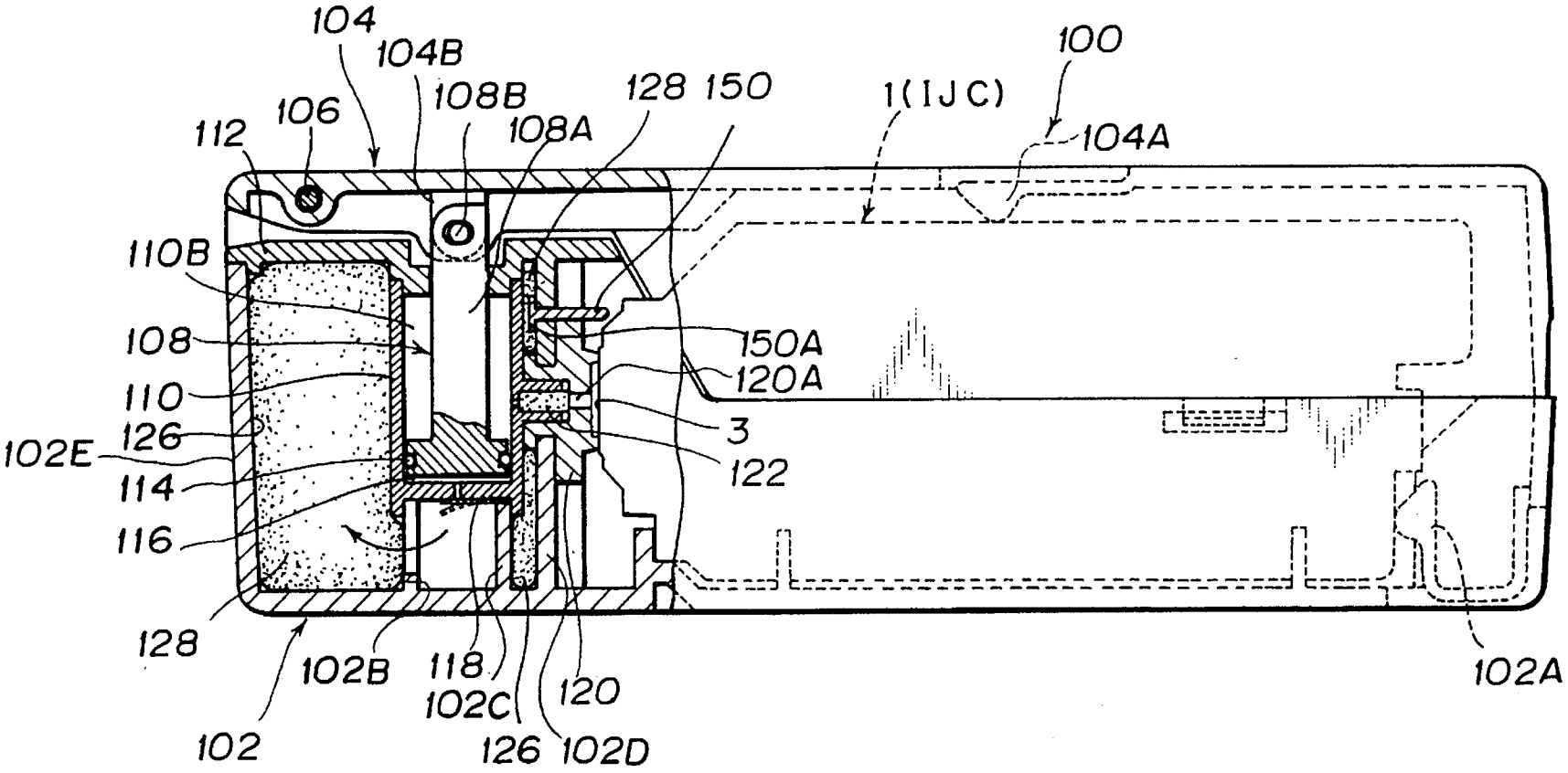
FIG. 13 is a partially exploded side view of a container for storably receiving an ink jet cartridge for an ink jet recording apparatus according to a ninth embodiment of the present invention.

Next, a container for storably receiving an ink jet cartridge for an ink jet recording apparatus according to a ninth embodiment of the present invention will be described below with reference to FIG. 13.

Figure 14:
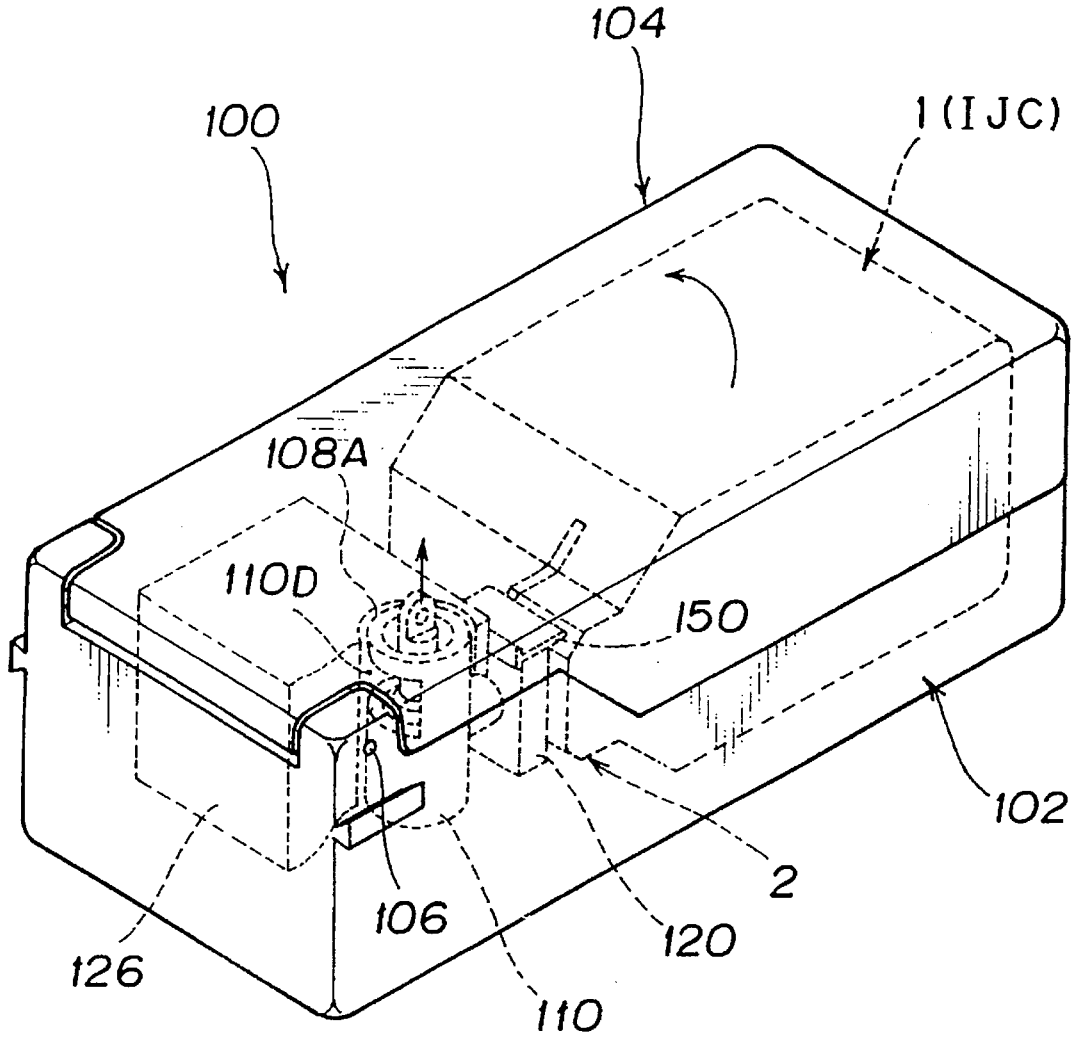
FIG. 14 is a perspective view of the container shown in FIG. 13.
Figure 15A:
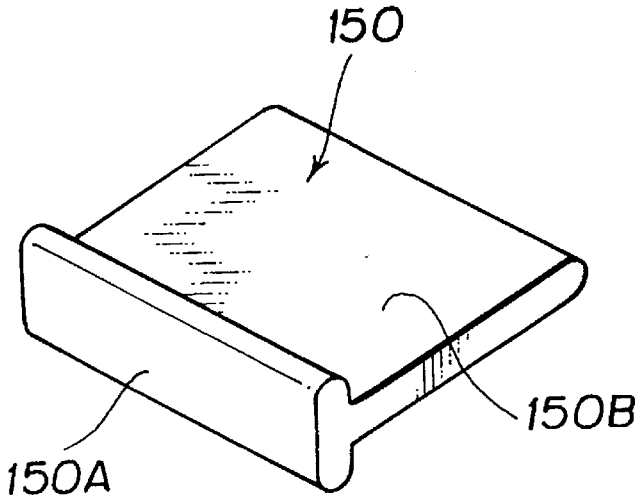
FIG. 15A is a perspective view of a wiping blade disposed in the container constructed according to the ninth embodiment of the present invention.
Figure 15B:
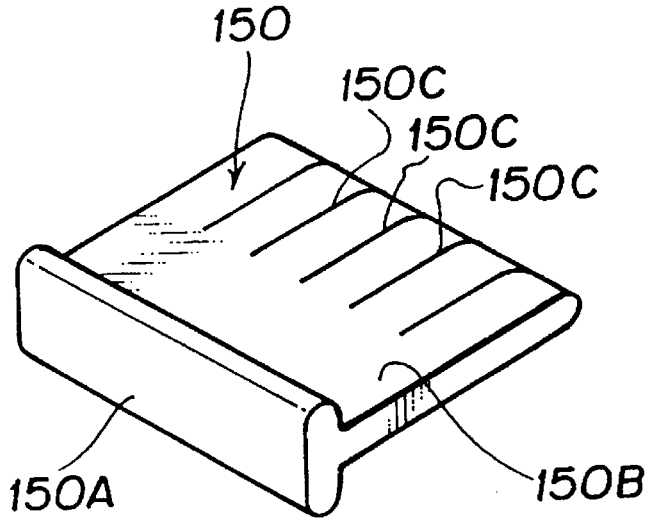
FIG. 15B is a perspective view of another wiping blade disposed in the container constructed according to the ninth embodiment of the present invention.

A characterizing feature of this embodiment consists in that a wiping blade 150 is molded of a porous elastic material to exhibit a configuration as shown in FIG. 15A or FIG. 15B and an ink absorber 128 is extensively arranged around a base end 150A of the wiping blade 150. In this embodiment, as shown in FIG. 14, a waste ink chamber 126 is designed to surround one half of a cylindrical cylinder member 110 and the ink absorber 128 is received in the waste ink chamber 126. With this construction, the ink once absorbed by the wiping blade 150 can be absorbed again in the ink absorber 128 via the wiping blade 150 itself. To reduce a magnitude of resistance arising during a pumping operation performed by a piston member 108 in operative association with turnable opening/closing of a case cover 104, a ventilation hole 110D is formed at the upper portion of the cylinder member 110 as shown in FIG. 14 so as to make communication between a cylinder chamber 110B and a waste ink chamber 128 via the ventilation hole 110D.

FIGS. 15A and 15B show by way of perspective views two types of wiping blades 150. One of the blades 150 shown in FIG. 15A is designed such that a blade portion 150B of the wiping blade 150 exhibits a plate-shaped contour, whereas the other type of wiping blade 150 shown in FIG. 15B is designed such that a plurality of slits 150C are additionally formed over a blade portion 150B in the spaced relationship while extending in parallel with each other. Especially, with the wiping blade 150 constructed in the last-mentioned manner, the foremost end of the wiping blade 150 comes in uniform contact with the ink discharging plane 3 of the recording head on the ink jet cartridge 1 with the aid of the slits 150C regardless of how the ink discharging plane 3 is designed and contoured, resulting in a wiping operation being effectively achieved.

Figure 17:
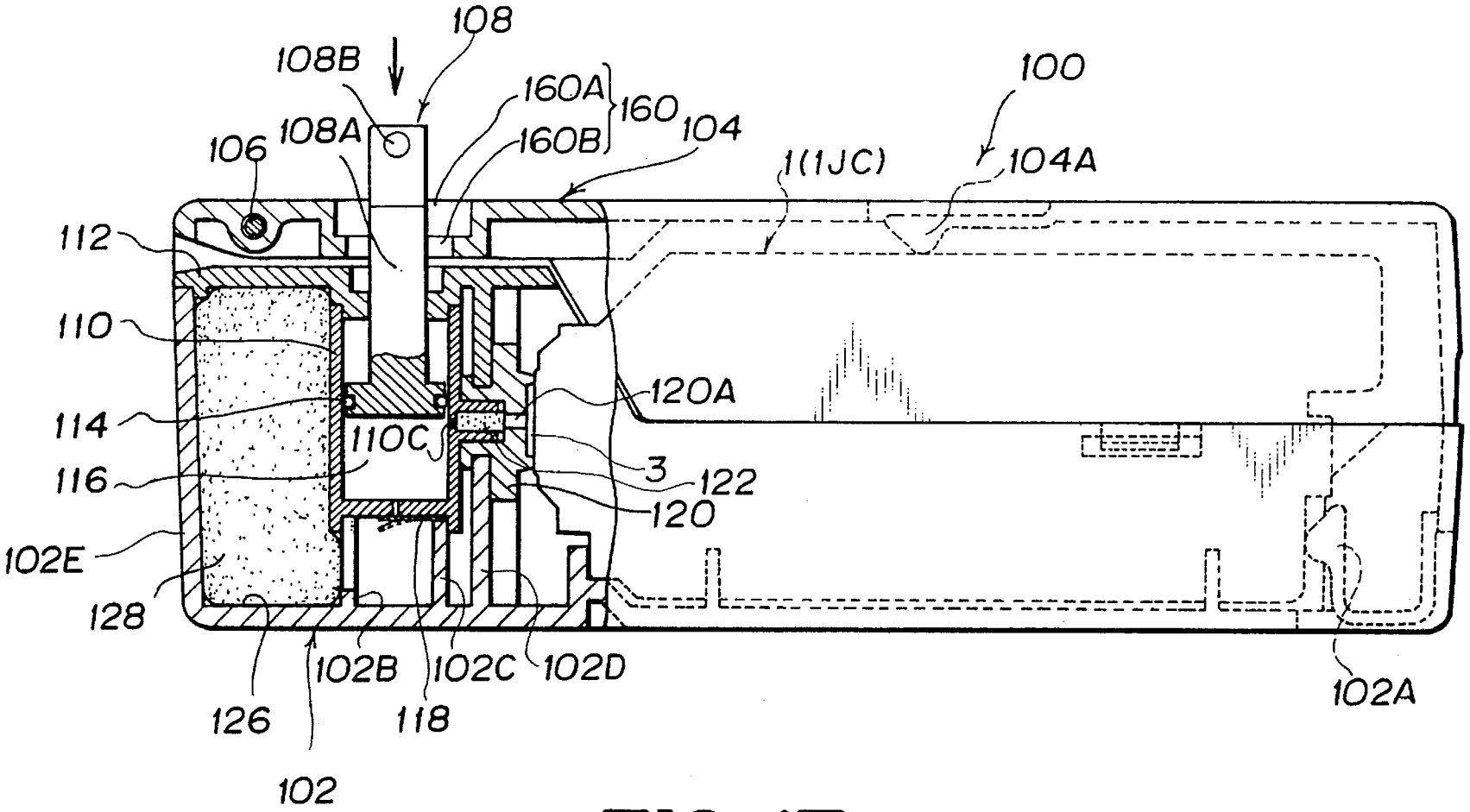
FIG. 17 is a partially exploded side view of the container constructed according to the tenth embodiment of the present invention, particularly showing a mode of operation of the container.
Figure 18:
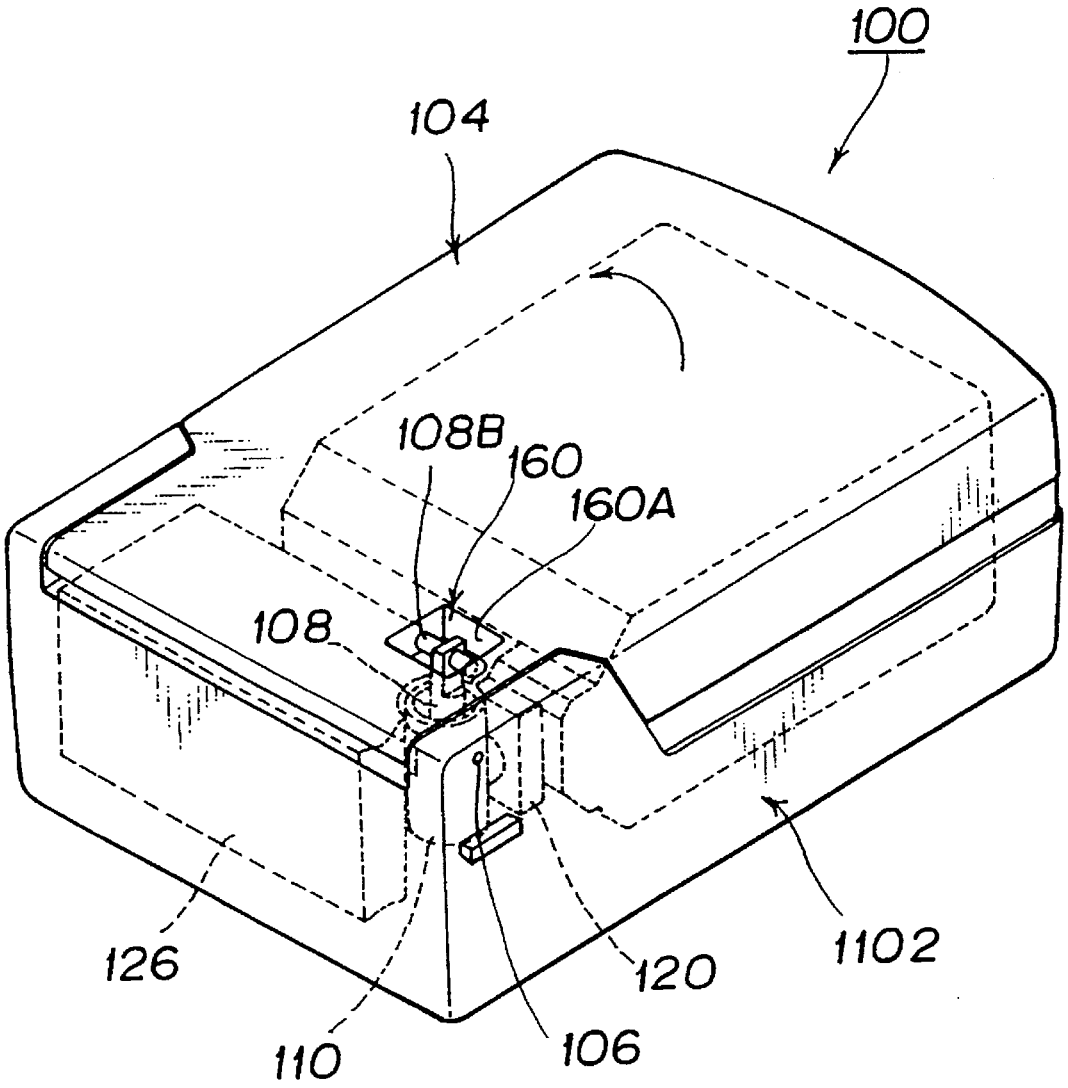
FIG. 18 is a perspective view of the container constructed according to the tenth embodiment of the present invention.

Next, a container according to a tenth embodiment of the present invention will be described below with reference to FIGS. 16 to 18.

A characterizing feature of this embodiment consists in that a member for connecting a piston member 108 and a case cover 104 to each other can selectively be released from the connected state so that when a user determines that there is no need of performing a recovery operation for the ink jet cartridge 1 to be achieved by the piston member 108, the foregoing member can be released from the connected state.

Figures 16A, 16B:
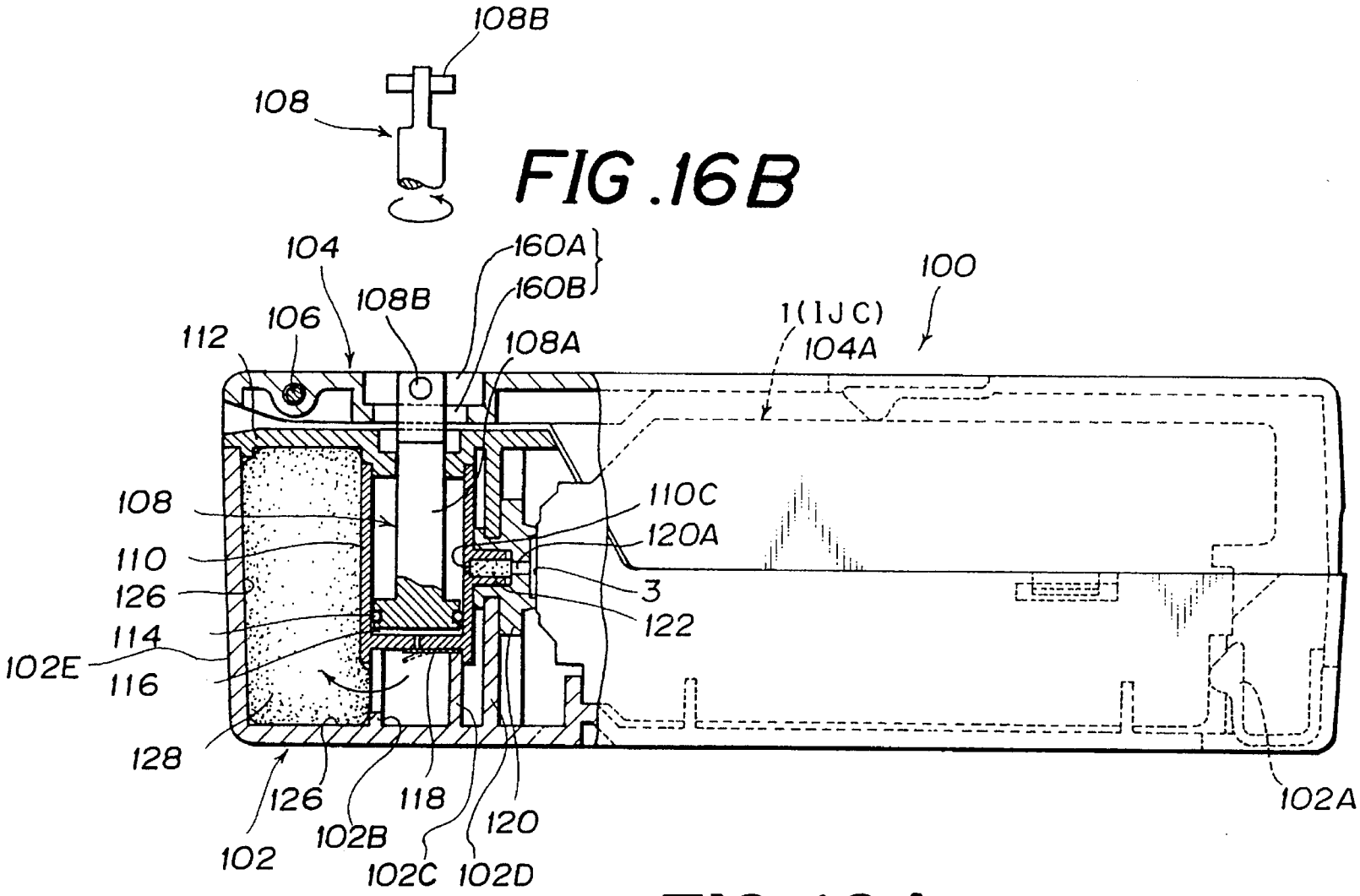
FIG. 16A is a partially exploded side view of a container for storably receiving an ink jet cartridge for an ink jet recording apparatus according to a tenth embodiment of the present invention.
FIG. 16B is a side view of a piston member for the container shown in FIG. 16A, particularly showing a mode of operation of the piston member for releasing it from the connected state relative to a case cover.

In FIG. 16A, reference numeral 160 designates an engagement hole. The engagement hole 160 consists of an upper engagement hole 160A and a lower engagement hole 160B in which a joint pin 108B of the piston member 108 is engaged with the case cover 104 or the former is disengaged from the latter. As is best seen in FIG. 18, the upper engagement hole 160A has a wide area enough to allow the connecting pin 108B to be turned in the upper engagement hole 160A with user's fingers. When the piston member 108 is held in a cylinder member 110 in the operative state as shown in FIG. 16A, the joint pin 108B is retained in the upper engagement hole 160A on the stepper part of the latter. Subsequently, when the joint pin 108B is turned by an angle of 90 degrees with user's fingers as shown in FIG. 16B, it is not engaged with the stepped part of the upper engagement hole 160A but it permits to pass through the lower engagement hole 160B. Similar to each of the aforementioned embodiments, a rod portion 108A of the piston member 108 is supported in the cylinder member 110 to slidably move through an opening portion formed through an intermediate case cover 112.

With the container 100 constructed in the above-described manner, in the case that there is a need of performing an activating operation for the ink jet cartridge 1 when the latter is taken out of the container 100, the case cover 104 is turnably opened by turning about a joint pin 106 while the piston member 108 is held in the state shown in FIG. 16A. In this case, since the joint pin 108B of the piston member 108 is engaged with the stepped part of the upper engagement hole 160A, as the case cover 104 is turnably opened, the piston member 108 is raised up to reach the position shown in FIG. 17. (Incidentally, to easily confirm that the piston member 108 is released from the connected state relative to the case cover 104, the case cover 104 is shown in the closed state in FIG. 17.)

As the piston member 108 is raised up in operative association with an operation for turnably opening the case cover 104, a negative pressure prevails in a pumping chamber 116 so that ink is sucked from an ink discharging plane 3 of the recording head unit on the ink jet cartridge 1. In the case that the case cover 104 is turnably opened in that way, the ink jet cartridge 1 is then taken out of the container 100, and thereafter, the case cover 104 is turnably closed in the reverse manner, the piston rod 108 is kept still in the state shown in FIG. 17. Subsequently, when the piston member 108 is depressed in the arrow-marked direction (see FIG. 17) while the upper end part of the piston member 108 is seized by a user, the ink sucked in the pumping chamber 116 can be conducted to the waste ink chamber 126.

In the case that a user determines that there is no need of performing an activating operation for the ink jet cartridge 1 when the latter is taken out of the container 100, the piston member 108 is turned by an angle of 90 degrees in the upper engagement hole 160A as shown in FIG. 16B by utilizing the joint pin 108B of the piston member 108 as a knob. Thus, since the joint pin 108B is permitted to pass through the engagement hole 160 without any interference with one of the upper and lower engagement holes 160A and 160B, the piston member 108 is not raised up at all. For this reason, no pumping operation is performed with the piston member 108 for the ink jet cartridge 1.

Next, a container according to an eleventh embodiment of the present invention will be described below with reference to FIG. 19.

In this figure, reference numeral 170 designates a slide lever which is fitted into a slide groove 172 formed through the upper wall of a case cover 104 to slidably move in the arrow-marked direction, and reference numeral 170A designates an engagement pin which is projected from the slide lever 170 toward the uppermost end of a rod portion 108A of a piston member 108. A joint hole 108G is formed through the uppermost end part of the rod portion 108A at the position corresponding to the engagement pin 170A such that the latter can loosely be inserted through the joint hole 108G. Other components rather than the aforementioned ones are like those in any one of the preceding embodiments. Thus, repeated description of these components will not be required.

Figure 19:
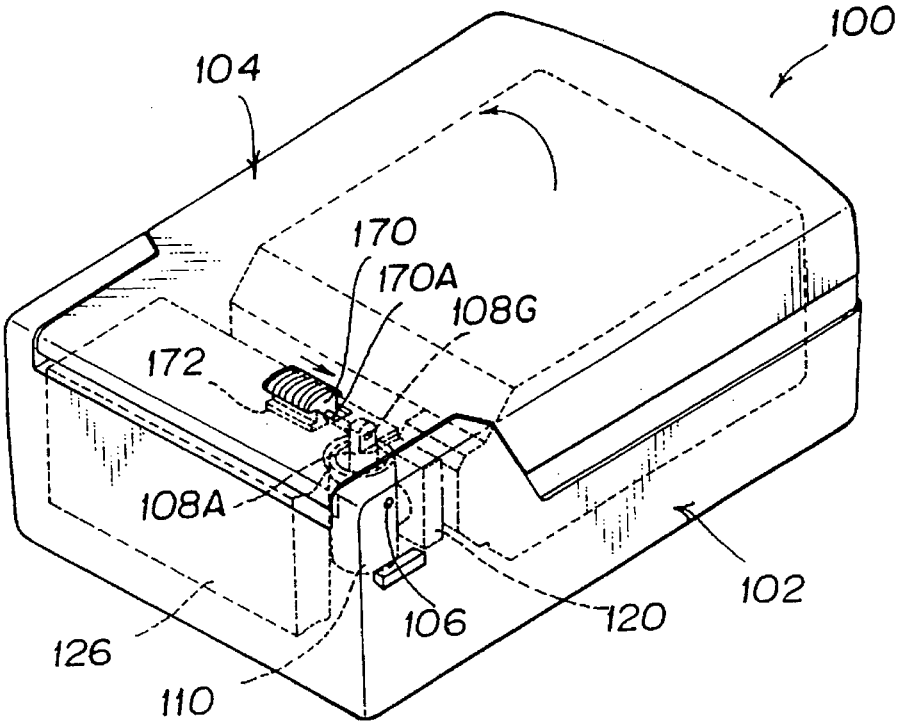
FIG. 19 is a perspective view of a container for storably receiving an ink jet cartridge for an ink jet recording apparatus according to an eleventh embodiment of the present invention.
Figure 20:
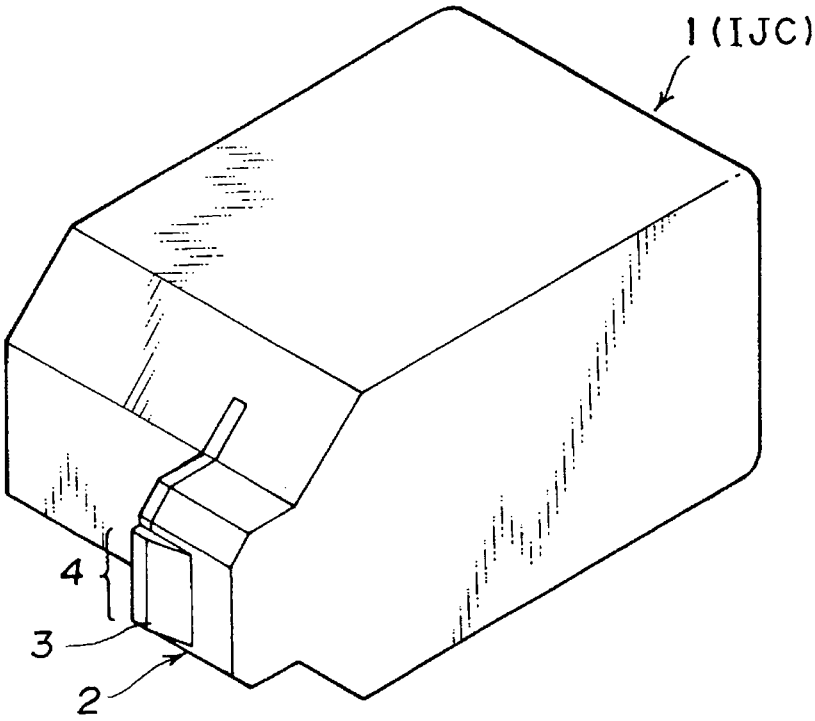
FIG. 20 is a perspective view of an ink jet cartridge to be storably received in a container to which the present invention is applied.
Figure 21:
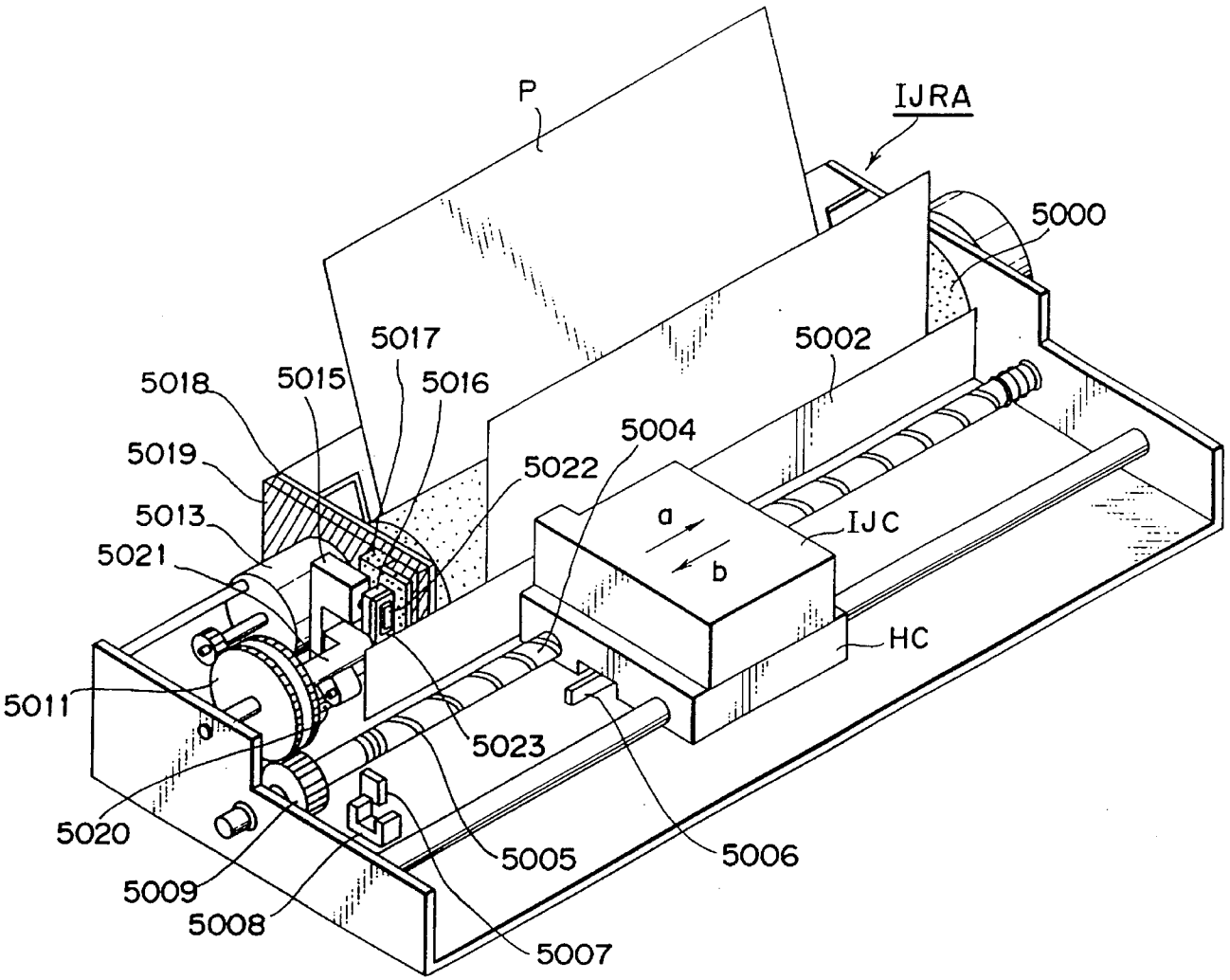
FIG. 21 is a perspective view of an ink jet recording apparatus for which the ink jet cartridge shown in FIG. 20 can practically be used for performing a series of recording operations.

With the container 100 constructed in the above-described manner, in the case that no activating operation is performed for the ink jet cartridge 1 in operative association with an operation for turnably opening or closing the case cover 104, the slide lever 170 is slidably displaced in the leftward direction as seen in FIG. 19 so that the engagement pin 170A is disengaged from the joint hole 108G of the rod portion 108A. On completion of the disengagement of the engagement pin 170A from the joint hole 108G, the piston member 108 is released from the case cover 104. On the contrary, in the case that it is required that an activating operation is performed for the ink jet cartridge 1, the slide lever 170 is slidably displaced in the arrow-marked direction, causing the engagement pin 170A to be inserted into the joint hole 108G, whereby the connected state can be restored with the container 100. While the foregoing connected state is maintained, the case cover 104 can turnably be opened or closed as desired in the same manner as any one of the preceding embodiments.

Although the eleven preferred embodiments of the present invention have been individually described above with reference to FIG. 1 to FIG. 19 with respect to a characterizing feature of a container for storably receiving an ink jet cartridge for an ink jet recording apparatus, it is obvious that the container may be constructed by combining some characterizing features selected from all the aforementioned characterizing features with each other. Additionally, of course, it is possible that e.g., the characterizing feature of the container as shown in FIG. 13 to FIG. 15 wherein the ink wiped out by wiping the ink discharging plane of the recording head unit with the aid of the wiping blade 150 is adsorptively collected in the ink absorber 128 received in the waste ink chamber 126 is additionally employed for the container 100 constructed according to any one of the other embodiments of the present invention.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip-type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A container for storably receiving an ink jet cartridge including a recording head section for discharging ink from a plurality of ink discharging orifices and an ink storing section having ink to be fed to said recording head section, said ink storing section being integrated with said ink recording head section, said container comprising:

a) a case main body comprising:

i) holding means for firmly holding said ink jet cartridge at a predetermined position in said container, ii) capping means for sealably covering said ink discharging orifices therewith while said ink jet cartridge is storably received at the predetermined position in said container, iii) pumping means for sucking ink through said ink discharging orifices while said orifices are sealably covered with said capping means and discharging the sucked ink and, iv) storing means for storing at least the ink discharged by said pumping means, b) a case cover for rotatably opening and closing relative to said case main body, c) connecting means for operatively connecting said pumping means to said case cover, d) wiping means for wiping an ink discharging surface having said ink discharging orifices formed thereon, said wiping means being disposed in a path of release of said ink jet cartridge from a firm held state at the predetermined position, wherein said ink storing means comprises a waste ink chamber defined in said container and an ink absorber is received in said waste ink chamber, said wiping means comprising a wiping blade made of a porous elastic material disposed above said capping means, and said wiping blade contacting said ink absorber.

2. A container as claimed in claim 1, wherein said waste ink chamber is defined by said container main body, an intermediate cover fitted to said container main body, and a cylinder member secured to said intermediate cover.

3. A container as claimed in claim 2, wherein said pumping means comprises said cylinder member, a piston adapted to be slidably displaced in said cylinder member, and a piston rod extending through said intermediate cover while the slidable displacement of said piston rod is adequately guided.

4. A container as claimed in claim 3, wherein said capping means is communicates with a pumping chamber of said pumping means via an orifice formed through a side wall of said cylinder member of said pumping means.

5. A container as claimed in claim 2, wherein said intermediate cover is attachable to and detachable from said container main body.

6. A container as claimed in claim 1, wherein said connecting means comprises releasing means for releasing said connecting means from a connected state when a very large magnitude of force is applied to said connecting means.

7. A container as claimed in claim 1, wherein said connecting means further comprises shifting means for selectively shifting a connected state to a disconnected state and vice versa.

8. A container as claimed in claim 1, wherein said case cover is rotatably connected to said case main body to rotate about a hinge pin, said case cover being displaceable within a certain allowable range in a direction at a right angle relative to an axis line of said hinge pin.

* * * * *

UNITED STATES PATENT AND TRADEMARK OFFICE

CERTIFICATE OF CORRECTION

PATENT NO. : 5,621,450

DATED : April 15, 1997

INVENTOR(S) : TSUTOMU KAWAI ET AL.

It is certified that error appears in the above-identified patent and that said Letters Patent is hereby corrected as shown below:

COLUMN 1

Line 65, "to" should read --to as--.

COLUMN 3

Line 24, "other" should read --another--.
Line 32, "other" should read --another--.
Line 40, "to" should be deleted.
Line 67, "elongated." should read --prolonged.--.

COLUMN 4

Line 23, "section the" should read --section, the--.
Line 25, "comprises;" should read --comprises:--.
Line 37, "comprise;" should read --comprise:--.
Line 54, "comprise;" should read --comprise:--.
Line 62, "comprise;" should read --comprise:--.

COLUMN 5

Line 5, "section the" should read --section, the--.
Line 6, "comprise;" should read --comprises:--.
Line 7, "comprises," should read --comprises:--.
Line 24, "comprise;" should read --comprise:--.

UNITED STATES PATENT AND TRADEMARK OFFICE

CERTIFICATE OF CORRECTION

PATENT NO. : 5,621,450

DATED : April 15, 1997

INVENTOR(S) : TSUTOMU KAWAI ET AL.

It is certified that error appears in the above-identified patent and that said Letters Patent is hereby corrected as shown below:

COLUMN 6

Line 4, "comprises;" should read --comprises:--.
Line 5, "comprises," should read --comprises:--.
Line 15, "ink and," should read --ink, and--.
Line 21, "comprising;" should read --comprising:--.
Line 58, "an;" should read --an--.
Line 61, "an other" should read --another--.

COLUMN 8

Line 34, "108." should read --108--.

COLUMN 10

Line 5, "neglected" should be deleted.
Line 9, "piston" should read --cylinder--.
Line 25, "there with," should read --therewith,--.
Line 61, "possibly" should be deleted.
Line 65, "represented" should read --represented by--.

COLUMN 11

Line 58, "lip 112" should read --lip 112A--.

COLUMN 12

Line 11, "is utilizing" should read --utilizes--.
Line 15, "above described" should read --above-described--.
Line 26, "to" should read --in--.
Line 34, "FIG. 140A" should read --FIG., 140A--.
Line 35, "lid 140A," should read --lid 140,--.
Line 48, "upper most" should read --uppermost--.

UNITED STATES PATENT AND TRADEMARK OFFICE

CERTIFICATE OF CORRECTION

PATENT NO. : 5,621,450

DATED : April 15, 1997

INVENTOR(S) : TSUTOMU KAWAI ET AL.

It is certified that error appears in the above-identified patent and that said Letters Patent is hereby corrected as shown below:

COLUMN 13

Line 24, "FIG. 8, in" should read --FIG. 8. In--.
Line 26, "beam 104" should read --beam 104E--.
Line 28, "beam 104" should read --beam 104E--.
Line 30, "beam 104" should read --beam 104E--.

COLUMN 14

Line 5, "possibly" should be deleted.
Line 8, "of" should be deleted.
Line 29, "exhibits" should read --exhibit--.
Line 43, "a" should read --an--.

COLUMN 18

Line 6, "sudden" should read --a sudden--.
Line 40, "consists" should read --consist--.

UNITED STATES PATENT AND TRADEMARK OFFICE

CERTIFICATE OF CORRECTION

PATENT NO. : 5,621,450

DATED : April 15, 1997

INVENTOR(S) : TSUTOMU KAWAI ET AL.

It is certified that error appears in the above-identified patent and that said Letters Patent is hereby corrected as shown below:

COLUMN 20

Line 7, "ink and," should read --ink, and--.
Line 17, "firm" should read --firmly--.
Line 37, "is" should be deleted.
Line 46, "of" should be deleted.

Signed and Sealed this

Fourth Day of November, 1997

Bruce Lehman

*Attest:*

BRUCE LEHMAN

*Attesting Officer*

*Commissioner of Patents and Trademarks*